US009176466B2

(12) United States Patent
Taba

(10) Patent No.: US 9,176,466 B2
(45) **Date of Patent: *Nov. 3, 2015**

(54) IMAGE FORMING APPARATUS WITH REMOVABLE CARTRIDGE AND MOVABLE LIGHT EMITTING MEMBER

(71) Applicant: CANON KABUSHIKI KAISHA, Tokyo (JP)

(72) Inventor: Yasuzumi Taba, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/178,787

(22) Filed: Feb. 12, 2014

(65) Prior Publication Data

US 2014/0227004 A1 Aug. 14, 2014

Related U.S. Application Data

(63) Continuation of application No. 13/114,491, filed on May 24, 2011, now Pat. No. 8,688,002.

(30) Foreign Application Priority Data

Jun. 2, 2010 (JP) ..... 2010-126813

(51) Int. Cl.
*G03G 21/18* (2006.01)

(52) U.S. Cl.
CPC ..... *G03G 21/1842* (2013.01); *G03G 21/185* (2013.01); *G03G 2221/1869* (2013.01)

(58) Field of Classification Search
CPC ..... G03G 21/185; G03G 21/1842; G03G 2221/1869
USPC ..... 399/110, 111, 118, 124; 347/138
See application file for complete search history.

(56) References Cited

U.S. PATENT DOCUMENTS

| | | | | |
|---|---|---|---|---|
| 5,140,369 | A | 8/1992 | Haneda | |
| 6,055,006 | A * | 4/2000 | Murano | 347/118 |
| 6,463,236 | B2 * | 10/2002 | Morikami et al. | 399/121 |
| 7,454,158 | B2 | 11/2008 | Nakano | |
| 7,720,411 | B2 | 5/2010 | Itabashi | |
| 8,688,002 | B2 * | 4/2014 | Taba | 399/111 |

(Continued)

FOREIGN PATENT DOCUMENTS

| | | |
|---|---|---|
| JP | 2002-311662 | 10/2002 |
| JP | 2007-199733 | 8/2007 |
| JP | 2008-224837 | 9/2008 |

(Continued)

OTHER PUBLICATIONS

Office Action in Japanese Patent Application No. 2014-093450, dated Mar. 3, 2015.

*Primary Examiner* — Sandra Brase
(74) *Attorney, Agent, or Firm* — Fitzpatrick, Cella, Harper & Scinto

(57) ABSTRACT

When an operation member is moved in a state in which a cartridge is mounted to an apparatus main body of an image forming apparatus, a cartridge supporting member is rotated away from a transfer member so that the cartridge is rotated and enters a state in which the cartridge is inclined at an angle θ1 with respect to the transfer member, and an exposure device is rotated away from the transfer member and enters a state in which the exposure device is inclined at an angle θ2 higher than the angle θ1 with respect to the transfer member.

60 Claims, 16 Drawing Sheets

(56) References Cited

U.S. PATENT DOCUMENTS

| | | | |
|---|---|---|---|
| 2009/0028601 | A1 | 1/2009 | Mizuno et al. |
| 2009/0290904 | A1 | 11/2009 | Kawai et al. |

FOREIGN PATENT DOCUMENTS

| | | | |
|---|---|---|---|
| JP | 2009-282396 | | 12/2009 |
| JP | 2011-253048 | A | 12/2011 |

* cited by examiner

IMAGE FORMING APPARATUS WITH REMOVABLE CARTRIDGE AND MOVABLE LIGHT EMITTING MEMBER

BACKGROUND OF THE INVENTION

1. Field of the Invention

The present invention relates to an electrophotographic image forming apparatus, in which a process cartridge including an electrophotographic photosensitive drum is detachably mounted to an apparatus main body to form an image on a recording medium.

The electrophotographic image forming apparatus forms an image on a recording medium by using an electrophotographic image forming process. Examples of the electrophotographic image forming apparatus include, for example, an electrophotographic copying machine, an electrophotographic printer, a facsimile machine, and a word processor. Besides, the recording medium is one on which an image is formed by the electrophotographic image forming apparatus, and paper, an OHT sheet, and the like are included therein, for instance.

The process cartridge contributes, in a state in which the process cartridge is detachably mounted to the apparatus main body of the electrophotographic image forming apparatus, to an image forming process for forming the image on the recording medium. The apparatus main body is a component of the electrophotographic image forming apparatus excluding a cartridge. The process cartridge is a cartridge into which at least one of charging means, developing means, and cleaning means each serving as process means and an electrophotographic photosensitive drum on which an electrostatic latent image is formed are integrally incorporated, and the thus formed cartridge is detachably mounted to the apparatus main body. The process means acts on the electrophotographic photosensitive drum. Therefore, a process cartridge may be a cartridge into which the developing means serving as the process means and the electrophotographic photosensitive drum are integrally incorporated, and the thus formed cartridge is detachably mounted to the apparatus main body. Further, a process cartridge may be a cartridge into which the charging means, the developing means, or the cleaning means serving as the process means and the electrophotographic photosensitive drum are integrally incorporated, and the thus formed cartridge is detachably mounted to the apparatus main body. Note that, the process cartridge, which integrally includes the electrophotographic photosensitive drum and the developing means, is referred to as a so-called integral type. Further, the process cartridge, which integrally includes the electrophotographic photosensitive member and the process means other than the developing means, is referred to as a so-called separation type. That is, the developing means is provided in a developing cartridge, which is different from the process cartridge, and the image formation is performed through a pair of the developing cartridge and the process cartridge. This is referred to as the so-called separation type. Thus, as the process cartridge, the so-called integral type or the so-called separation type process cartridge may be used. Further, as the process cartridge, the so-called separation type process cartridge and the developing cartridge may be used as a pair. The process cartridge can be mounted and removed from the apparatus main body by the user him/herself. Therefore, the maintenance of the apparatus main body may easily be performed.

2. Description of the Related Art

In order to downsize the electrophotographic image forming apparatus, a light emitting member including multiple light emitting elements which are provided side-by-side in a longitudinal direction of the electrophotographic photosensitive drum (hereinafter, referred to as a drum) and emit light for exposing the drum according to image information is used in some cases as an exposure device for the drum. Typical examples of the light emitting member include an LED head array. An exposure device using LEDs needs to have a short focal length, and hence it is necessary to provide an array in the vicinity of the surface of the drum. Thus, in order to replace the process cartridge including the drum, it is essential that the array is spaced away from the drum. Japanese Patent Application Laid-Open No. 2008-224837 discloses such a structure that the array is largely retracted away from the cartridge on an outside of the apparatus main body.

However, the above-mentioned related art has the problems as follows. The array is retracted away from the cartridge on the outside of the apparatus main body, and hence it is probable that the array fouls owing to dust in the outside air, which may cause image defects. Further, the array is easily touched by an operator at the time of replacement of the cartridge, and hence needs to be handled with care.

In other words, it is difficult to simultaneously achieve replacement of the cartridge, prevention of the array fouling, and facility of the operation. As a countermeasure, it is desired that the array stay in the image forming apparatus at the time of replacement of the cartridge.

SUMMARY OF THE INVENTION

Under the circumstances, the present invention has been made in view of the above-mentioned problems with the conventional art. An object of the present invention is to provide an electrophotographic image forming apparatus in which a light emitting member including multiple light emitting elements is difficult to foul at the time of replacement of a process cartridge, and the process cartridge can be replaced without attention to the light emitting member.

Another object of the present invention is to provide an image forming apparatus to which a cartridge having a photosensitive drum is detachably mounted, the image forming apparatus comprising: an exposure device having multiple light emitting elements arranged in an array, the multiple light emitting elements exposing the photosensitive drum; a transfer member configured to transfer a toner image formed on the photosensitive drum onto a recording medium; a cartridge supporting member configured to support the cartridge mounted to an apparatus main body; and an operation member which is operated and moves when the cartridge is mounted to the apparatus main body, wherein the cartridge supporting member and the exposure device are rotatable about a supporting point on a downstream side in an insertion direction in which the cartridge is inserted into the apparatus main body, in association with a movement of the operation member, and wherein when the operation member is moved in a state in which the cartridge is mounted to the apparatus main body, the cartridge supporting member is rotated away from the transfer member so that the cartridge is rotated and enters a state in which the cartridge is inclined at an angle $\theta 1$ with respect to the transfer member, and the exposure device is rotated away from the transfer member and enters a state in which the exposure device is inclined at an angle $\theta 2$ larger than the angle $\theta 1$ with respect to the transfer member so that the cartridge is allowed to be detachable from the apparatus main body.

According to the present invention, when the process cartridge is detached and mounted to the apparatus main body, the process cartridge is retracted away from the transfer member, and the light emitting member is retracted away from the process cartridge inside the apparatus main body. With this, the light emitting member is not exposed to dust in the outside air. As a result, a highly reliable electrophotographic image forming apparatus with no fouling of the light emitting member is attained. Further, the light emitting member cannot be touched by a user, and hence the user does not need to pay attention to the light emitting member when replacing the process cartridge. As a result, an electrophotographic image forming apparatus having high operability is attained.

Further features of the present invention will become apparent from the following description of exemplary embodiments with reference to the attached drawings.

DESCRIPTION OF THE EMBODIMENTS

Embodiment 1

Overall Schematic Structure of Electrophotographic Image Forming Apparatus

Figure 2A:
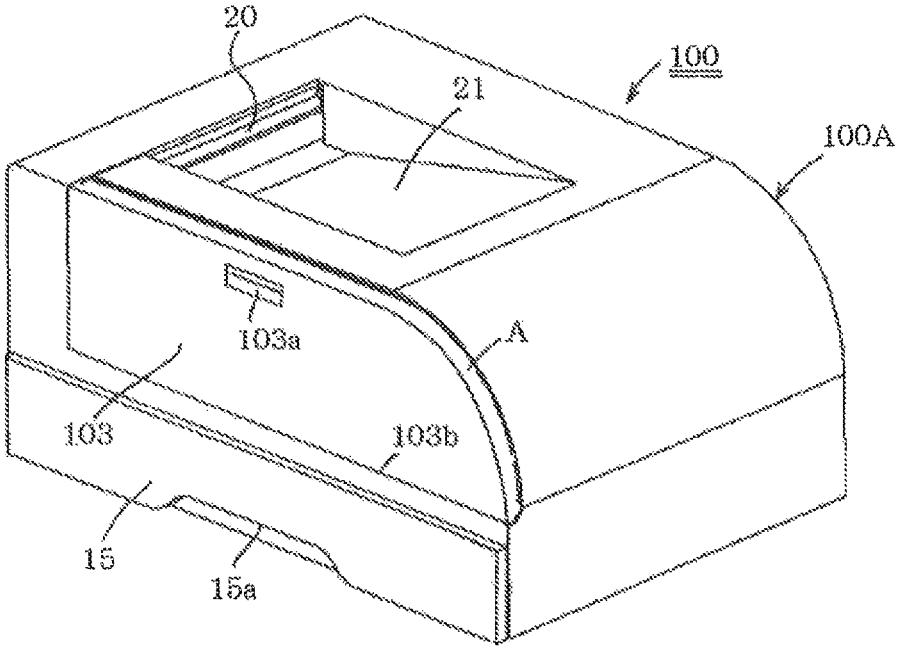
FIG. 2A is an external perspective view of an image forming apparatus.
Figure 2B:
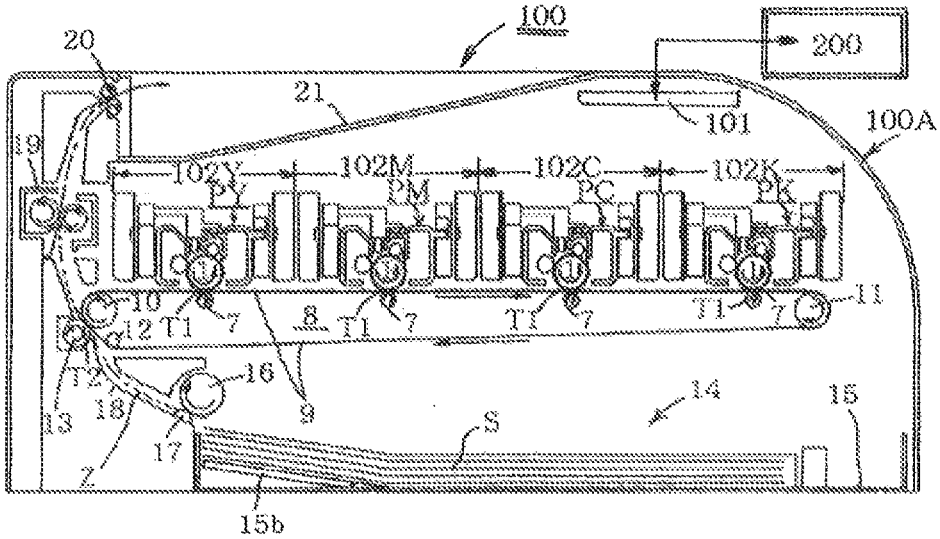
FIG. 2B is a vertical sectional view of the image forming apparatus.
Figure 3A:
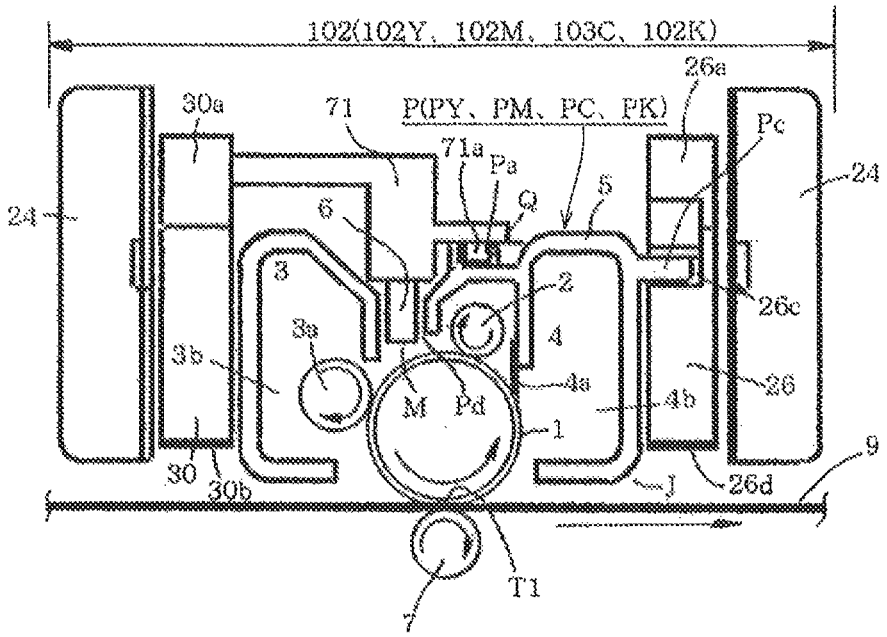
FIG. 3A is a partial enlarged view of FIG. 2B.
Figure 3B:
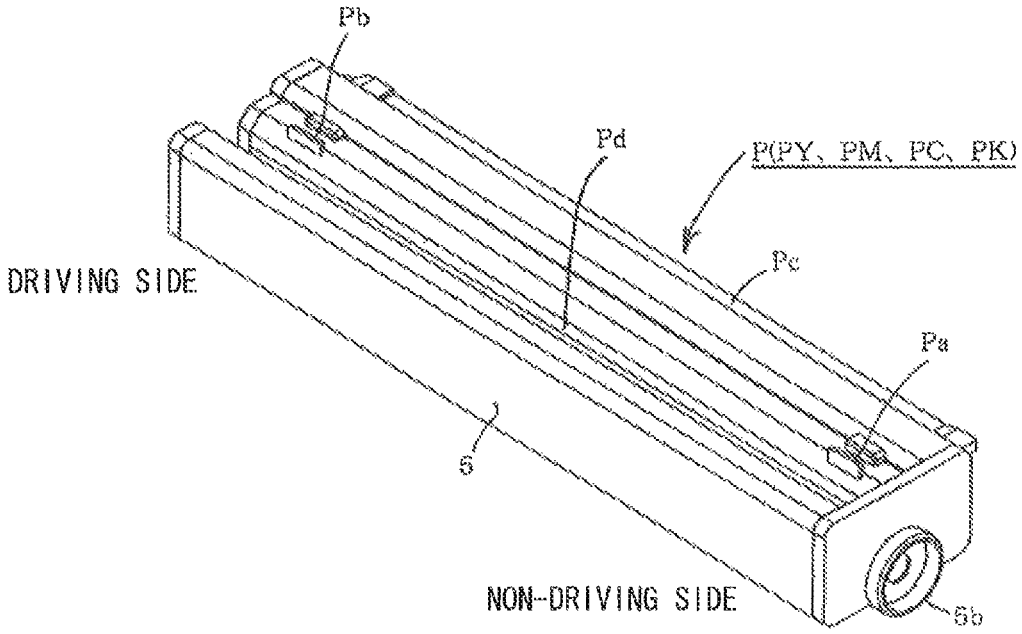
FIG. 3B is an external perspective view of a process cartridge.

FIG. 2A is an external perspective view of an electrophotographic image forming apparatus 100 of this embodiment, FIG. 2B is a vertical sectional view of the apparatus 100, FIG. 3A is a partial enlarged view of FIG. 2B, and FIG. 3B is an external perspective view of a process cartridge P. The apparatus 100 is an inline type and intermediate transfer type color electrophotographic image forming apparatus that forms a color image on a recording medium S in a state in which four process cartridges P each including an electrophotographic photosensitive drum 1 are detachably mounted to respective mounting portions in a main body 100A of the apparatus. An LED head array (LED type exposure device) is used as an exposure device (light emitting member) 6 for exposing the drum 1. Specifically, the apparatus 100 is a four-full-color LED printer, which uses an electrophotographic process and conducts a color image formation on the recording medium S based on an electrical image signal, which is input from a host apparatus 200 such as a personal computer, an image reader, and the like to a control circuit portion 101. The recording medium S (hereinafter, also referred to as recording material) is, for example, paper, an OHP sheet, or a label.

Here, in the following description, regarding the apparatus 100, a front side (frontal side) refers to a side on which a door (openable and closable member) 103 is arranged. A rear side (inner-end side) refers to an opposite side thereto. A front-rear direction refers to a direction from the rear side toward the front side of the apparatus (front direction), and an opposite direction thereto (rear direction). A left or right refers to a left or a right when the image forming apparatus is viewed from the front side. A lateral direction refers to a direction from right toward left (left-hand direction) and an opposite direction thereto (right-hand direction). An upper or lower side refers to an upper side or a lower side in the direction of the force of gravity. The main body 100A of the apparatus refers to a structural portion of the apparatus 100 excluding the cartridges P.

In the main body 100A of the apparatus, first to fourth four process-cartridge mounting portions 102 (102Y, 102M, 102C, and 102K) are substantially horizontally arranged side-by-side from a left side to a right side. First to fourth four process cartridges P (PY, PM, PC, and PK) are detachably mounted to the respective mounting portions 102. The mounting portions 102 have the same structure. Description of the structure of the mounting portions 102 will be provided later.

The cartridges P respectively contain developers having colors different from one another, and otherwise, have electrophotographic process mechanisms similar to one another. In each of the cartridges P in this embodiment, the electrophotographic photosensitive drum 1, charging means 2, developing means 3, and cleaning means 4 as process means which act on the drum 1 are integrally incorporated in a predetermined arrangement relation into a cartridge frame body 5 so as to be made into a cartridge. The drum 1 is supported rotatably with respect to the frame body 5 through a bearing (not shown). Each of the cartridges P is an assembly longitudinal in a rotation axial direction of the drum 1. One end side in the rotation axial direction of the drum 1 is a driving side, and another end side thereof is a non-driving side. Each of the cartridges P is mounted at a predetermined position, with the driving side thereof with respect to the mounting portion 102 of the main body 100A of the apparatus being defined as an inner-end side thereof and the non-driving side thereof being defined as an opening-end side thereof. A drive input portion 5*a* (FIG. 7B) is arranged at an end surface on the driving side of each of the cartridges P. The charging means 2 is means for uniformly charging a peripheral surface of the drum 1 with a predetermined polarity and electric potential, and a charging roller which is a contact charging member is used as the charging means 2. The developing means 3 is means for developing an electrostatic latent image formed on the drum 1 into a toner image with use of a powdered developer (toner), and includes a developing roller 3*a* as a developing member configured to supply the developer to the drum 1, and a developer containing portion containing the developer. The cleaning means 4 is means for removing after-transfer residual developer from the drum surface after primary transfer of the toner image with respect to an intermediate transfer belt 9 as an intermediate recording medium, and includes a cleaning blade 4*a* as a cleaning member and a waste-developer containing portion 4*b*. The first cartridge PY contains developer of yellow (Y) color in a developer containing portion 3*b*, and a toner image of Y color is formed on a surface of the drum 1. The second cartridge PM contains developer of magenta (M) color in the developer containing portion 3*b*, and a toner image of M color is formed on the drum 1. The third cartridge PC contains developer of cyan (C) color in the developer containing portion 3*b*, and a toner image of C color is formed on the drum 1. The fourth cartridge PK contains developer of black (K) color in the developer containing portion 3*b*, and a toner image of K color is formed on the drum 1.

Figure 17:
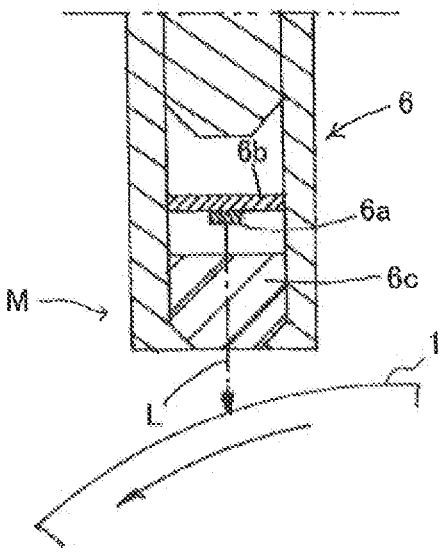
FIG. 17 is an enlarged lateral sectional view illustrating a distal end side of an LED unit at the exposure position.

In a state in which each of the cartridges P is mounted to the corresponding mounting portion 102 at the predetermined portion and is at an image forming position J (FIG. 3A), a drum gear 28 of a driving unit 27 (FIGS. 5B and 6B) on a main body 100A side of the apparatus is coupled to the drive input portion 5*a*. Further, a bias input portion (not shown) on a cartridge-P side is in such a state as to be coupled to a bias output portion (not shown) on the main body 100A side of the apparatus. Still further, with respect to the drum 1 of each of the cartridges P at the image forming position J, the LED head array 6 as an exposure device on the main body 100A side of the apparatus is at such a predetermined exposure position M (FIG. 3A) as to expose the drum 1. FIG. 17 is an enlarged lateral sectional view illustrating a distal end side of the array 6 at such a predetermined exposure position M as to expose the drum 1. The array 6 is a light emitting member including multiple LEDs (light emitting diodes) 6*a* as light emitting elements which are provided side-by-side in the rotation axial direction (longitudinal direction) of the drum 1 and emit light for exposing the drum 1 according to image information. Further, the array 6 includes an LED substrate 6*b* and a SELFOC (registered trademark) lens 6*c*. The lens 6*c* is a lens configured to converge light beams emitted from the LEDs 6*a* and apply the light beams onto the drum 1. That is, the array 6 is exposure means in which the multiple LEDs 6*a* are selectively light-emitting controlled correspondingly to the image information input from the control circuit portion 101 and which performs main scanning exposure onto the surface of the rotated drum 1 that has undergone a charging process by the charging roller 2 so as to form an electrostatic latent image corresponding to the image information. In the apparatus 100 in this embodiment, the array 6 outputs light beams L (LY, LM, LC, and LK) which have been modulated correspondingly to respective image information pieces of colors of Y, M, C, and K, the image information pieces being input from the host apparatus 200 into the control circuit portion 101. Then, the array 6 performs scanning exposure on the drums 1 of the cartridges P of corresponding colors. In summary, the array 6 as a light emitting member is positioned to the exposure position M in a state in which the cartridge P is positioned to an image forming position C. The array 6 includes multiple light emitting elements which are provided side-by-side in the longitudinal direction of the drum 1 and expose the drum 1 according to the image information.

An intermediate-transfer-belt unit 8 as a transfer member is arranged below the mounting portions 102. The unit 8 includes an endless belt (intermediate transfer belt) 9 serving as an intermediate recording medium and having a flexibility, and a drive roller 10, a turn roller 11, and a tension roller 12 which tense and circulate the belt 9. The drive roller 10 and the tension roller 12 are arranged on the left side in the apparatus main body 100A. The turn roller 11 is arranged on the right side in the main body 100A of the apparatus. Lower surfaces of the drums 1 of the cartridges P at the image forming position J are held in contact with an upper surface of the belt 9. The contact portions are primary-transfer nip portions T1. On an inside of the belt 9, primary transfer rollers 7 are arranged so as to face the drums 1 of the cartridges P through upper sides of the belt at such positions as to correspond to the nip portions T1. A secondary transfer roller 13 is held in contact with the drive roller 10 through the belt 9. The contact portion is a secondary-transfer nip portion T2. The unit 8 is a transfer member positioned in the main body 100A of the apparatus and configured to transfer a toner image onto the belt 9 as an intermediate recording medium.

A feed unit 14 is arranged below the unit 8. The unit 14 includes a feed tray 15, a feed roller 16, and a separation pad 17. The sheet-like recording materials S are stacked in the tray 15. The tray 15 is freely pushed in and pulled out of the front side of the apparatus 100 (frond loading). A grip portion 15*a* is provided to a front-surface plate of the tray 15. On the left side in the main body 100A of the apparatus, a recording-material conveyance path Z is arranged so as to extend from the feed roller 16 to an upper portion on the left side in the main body 100A of the apparatus. The conveyance path Z is constituted by a conveyance guide plate 18 and the like. The secondary transfer roller 13, a fixing device (heat-fixing device) 19, and a delivery roller pair 20 are arranged from bottom to top along the conveyance path Z. The fixing device 19 includes a heat roller and a pressure roller. A delivery tray 21 configured to receive recording materials that have undergone image formation is arranged on an upper surface of the main body 100A of the apparatus.

Operation for forming a full-color image is as follows. Based on an image formation start signal, the drum 1 of each of the cartridges P is rotationally driven at a predetermined speed in a counterclockwise direction as indicated by the arrows. The belt 9 is also rotationally driven at a speed corresponding to the speed of the drum 1 in a clockwise direction (forward direction to the drum rotation) as indicated by the arrows. In synchronism with the drive, in each of the cartridges P, a predetermined charge bias is applied to the charging roller 2 at predetermined control timing, to thereby uniformly charge the surface of the drum 1 to a predetermined polarity and predetermined electric potential. In the array 6, the multiple LEDs 6*a* as light emitting elements are selectively light-emitting controlled in accordance with the image information input from the control circuit portion 101, and the main scanning exposure is performed onto the surface of the drum 1 that has undergone the charging process by the charging roller 2. With this, an electrostatic latent image according to an image signal of a corresponding color is formed on the surface of each of the drums 1. The electrostatic latent image thus formed is developed into a toner image by the developing roller 3*a*. A predetermined developing bias is applied to the developing roller 3*a* at predetermined control timing.

By an electrophotographic image forming process operation as described above, a Y-color toner image corresponding to a Y-color component of a full-color image is formed on the drum 1 of the first cartridge PY. The toner image is primary-transferred (intermediate-transferred) onto the belt 9. A primary transfer bias having a reverse polarity with respect to a charging polarity of the developer and having a predetermined electric potential is applied from a power supply portion (not shown) to each of the primary transfer rollers 7. An M-color toner image corresponding to an M-color component of the full-color image is formed on the drum 1 of the second cartridge PM. The toner image is primary-transferred and superimposed on the Y-color toner image that has already been transferred on the belt 9. A C-color toner image corresponding to a C-color component of the full-color image is formed on the drum 1 of the third cartridge PC. The toner image is primary-transferred and superimposed on the Y-color and M-color toner images that have already been transferred on the belt 9. A K-color toner image corresponding to a K-color component of the full-color image is formed on the drum 1 of the fourth cartridge PK. The toner image is primary-transferred and superimposed on the Y-color, M-color, and C-color toner images that have already been transferred on the belt 9. In this manner, full-color four unfixed toner images of the Y-color, the M-color, the C-color, and the K-color are formed on the belt 9. In each of the cartridges P, residual developer on the surface of the drum 1 is removed by the cleaning means 4 after the primary transfer.

Meanwhile, when a lifter plate 15*b* of the tray 15 is raised at predetermined control timing, a left-side upper surface of the recording material S stacked in the tray 15 is brought into contact with a lower surface of the roller 16. Further, the roller 16 is rotationally driven in such a direction as to send out the recording material S to the left side. With this, an uppermost one of the recording materials in the tray 15 is sent out to the left side, and then separated as one sheet by the separation pad 17 so as to be sent into the conveyance path Z. After that, the recording material S is introduced into the secondary-transfer nip portion T2. A secondary transfer bias having a reverse polarity with respect to the charging polarity of the developer and having a predetermined electric potential is applied from the power supply portion (not shown) to the roller 13. With this, during a process in which the recording material S is conveyed through the nip portion T2, four-color-superimposed toner images on the belt 9 are collectively transferred onto the surface of the recording material S. The recording material S is separated from the surface of the belt 9 after getting out of the nip portion T2, and then introduced into the fixing device 19 so as to be heated and pressed at a fixing nip portion. With this, the toner image is fixed to the recording material S. The recording material S gets out of the fixing device 19, and then delivered onto the tray 21 as a full-color image product by the roller pair 20. In the apparatus 100 in this embodiment, after-secondary-transfer residual developer on the surface of the belt 9 after separation of the recording material is collected by the drum 1 of the first cartridge PY, and then is removed from the drum surface by the cleaning means 4.

<Cartridge Replacement Method>

Along with use in image formation, the developer contained in the developing means 3 of each of the cartridges P is consumed. In this context, for example, detection means (not shown) for detecting a residual amount of the developer in each of the cartridges is provided in each of the cartridges. Then, in the control circuit portion 101 of the main body 100A of the apparatus, a residual amount value detected by the detection means is compared to a preset threshold for a life notice and a life alarm of each of the cartridges. Then, in a case where the residual amount value of the developer has decreased to a residual amount value smaller than the threshold in any of the cartridges, a life notice or a life alarm of the cartridge is displayed on a display portion (not shown). With this, a user is urged to prepare a cartridge for replacement or replace the cartridge. In this manner, quality of output images is maintained.

Figure 4A:
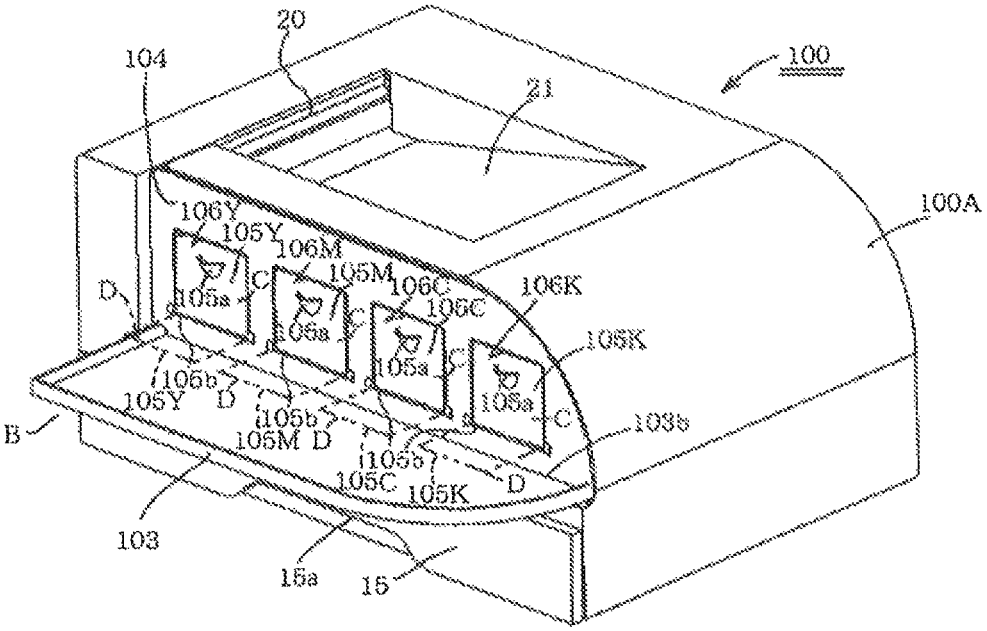
FIG. 4A is an external perspective view of the image forming apparatus in a state in which an apparatus openable and closable door on an apparatus-front-surface side is opened.
Figure 4B:
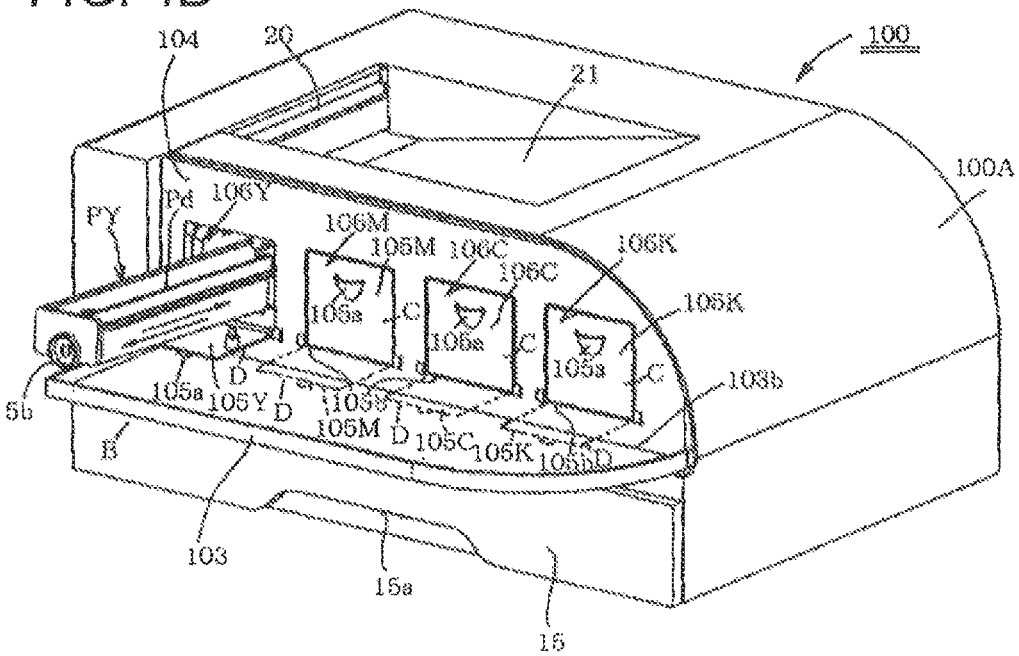
FIG. 4B illustrates a state in which one of cartridge doors is opened and the process cartridge is pulled out or inserted.

In the apparatus 100 in this embodiment, the cartridges P are replaced as follows. An apparatus openable and closable door 103 on a front-surface side of the apparatus 100 is manually opened by a user as illustrated in FIG. 4A. A grip portion 103*a* is provided on a front surface of the door 103. When the door 103 is opened, individual cartridge doors 105 (105Y, 105M, 105C, and 105K) are exposed which are provided in an opening-end-side frame 104 of a main frame constituting a frame of the main body 100A of the apparatus and correspond respectively to the cartridges. Further, when the door 103 is opened, a door switch (not shown) is turned off, with the result that a power supply circuit (not shown) of the apparatus 100 is maintained in an open state. Then, the cartridge door 105 corresponding to the cartridge P to be replaced is opened. This is the method employed in the apparatus 100, that is, the cartridges P are replaced by front access. Mounting/detaching of the cartridges P with respect to the main body 100A of the apparatus is performed with such a side-oriented structure as to allow the cartridges P to be mounted and detached in the rotation axial direction of the drum 1 of corresponding one of the cartridges P and on a frontal side of the apparatus main body. FIG. 4B illustrates a state in which the cartridge door 105Y corresponding to the first cartridge PY is opened and the cartridge PY is in the middle of being pulled out from or in the middle of being inserted into the mounting portion 102Y.

The door 103 is provided, on the front-surface side of the main body 100A of the apparatus, as an openable and closable member movable between such a closing position A (FIG. 2A) as to cover a front surface of the frame 104 and such an opening position B (FIG. 4A) as to expose the front surface of the frame 104. In this embodiment, the door 103 can be pivoted about a hinge shaft 103*b* at a lower end portion of the door with respect to the main body 100A of the apparatus. That is, the door 103 can be pivoted about the shaft 103*b* by the user in a raising direction so as to be moved to such a closing position A as to close the front surface of the frame 104 as illustrated in FIG. 2A. The door 103 at the closing position A is held thereat by a hook mechanism, a toggle mechanism, or the like (not shown). Further, the door 103 at the closing position A is pivoted about the shaft 103*b* so as to be substantially horizontally put down toward the opening-end side of the main body 100A of the apparatus by the user who hooks his/her finger to the grip portion 103*a* so as to disengage the hooking or against a toggle force. With this, as illustrated in FIG. 4A, the door 103 can be moved to such an opening position B as to largely open the front surface of the frame 104. The door 103 at the opening position B is held thereat.

The frame 104 is provided with four cartridge push-in/pull-out opening portions 106 (106Y, 106M, 106C, and 106K) corresponding respectively to the cartridges P. The opening portions 106 are opening portions through which the cartridges P are passed so as to be inserted into the respective corresponding mounting portions 102 in the main body 100A of the apparatus and removed therefrom. For each of the opening portions 106, the cartridge door 105 as an openable and closable member movable between such a closing position C (first operating position) as to close the opening portion 106 and such an opening position D (second operating position) as to open the opening portion 106 is provided in the main body 100A of the apparatus. A grip portion 105*a* is provided on a front surface of each of the doors 105. When mounting/detaching the cartridges P, first, the user opens the door 103 so that the cartridge doors 105 corresponding to the cartridges P of the respective colors are accessible to the user. In this embodiment, each of the doors 105 is pivotable so as to be openable and closable about a hinge shaft 105*b* in a lateral direction at a lower end portion of the door with respect to the frame 104. The door 105 can be pivoted about the shaft 105*b* by the user in a raising direction so as to be moved to such a closing position C as to close the opening portion 106. The door 105 at the closing position C is held thereat by a hook mechanism, a toggle mechanism, or the like (not shown). Further, the door 105 at the closing position C can be moved to such an opening position D as to largely open the opening portion 106 by being pivoted about the shaft 105*b* so as to be substantially horizontally put down toward the opening-end side of the frame 104 by the user who hooks his/her finger to the grip portion 105*a* so as to disengage the hooking or against a toggle force. The door 105 at the opening position D is held thereat.

<Cartridge Mounting Portion>

Figure 5A:
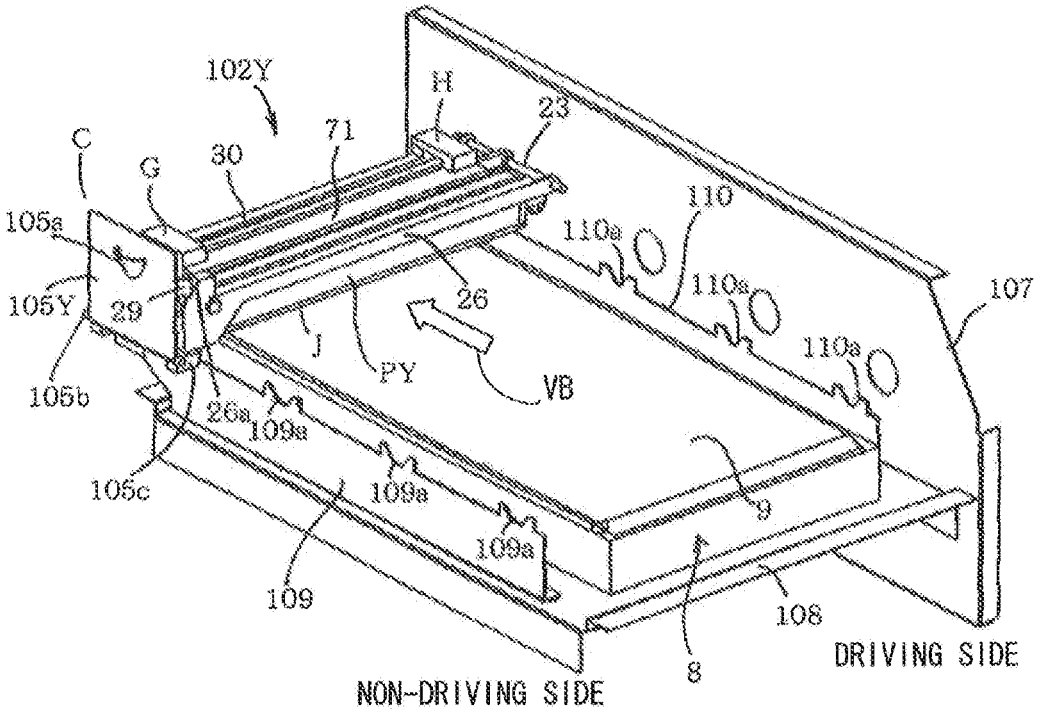
FIG. 5A is a perspective view of one of cartridge mounting portions.
Figure 5B:
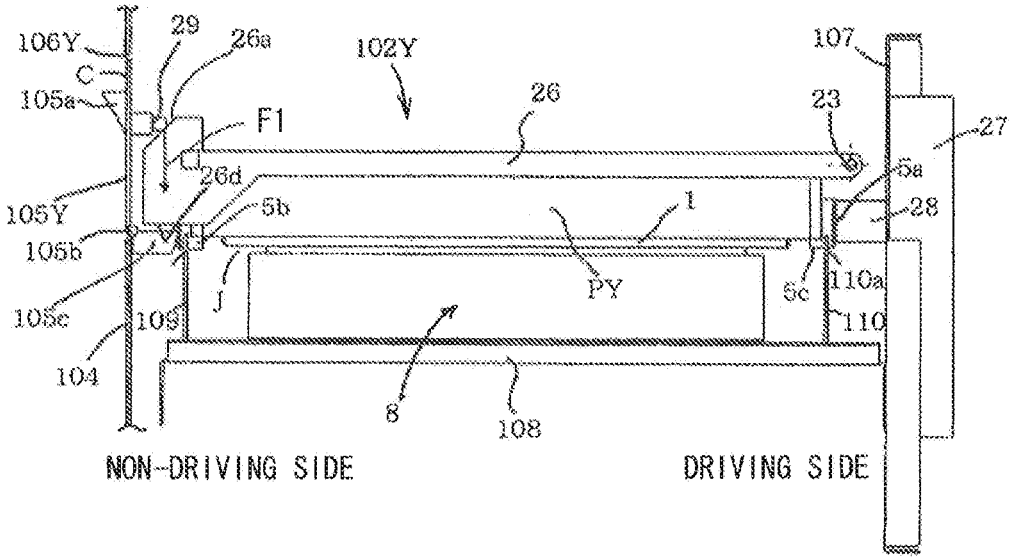
FIG. 5B illustrates the cartridge mounting portion as viewed along a direction indicated by the arrow VB of FIG. 5A.
Figure 6A:
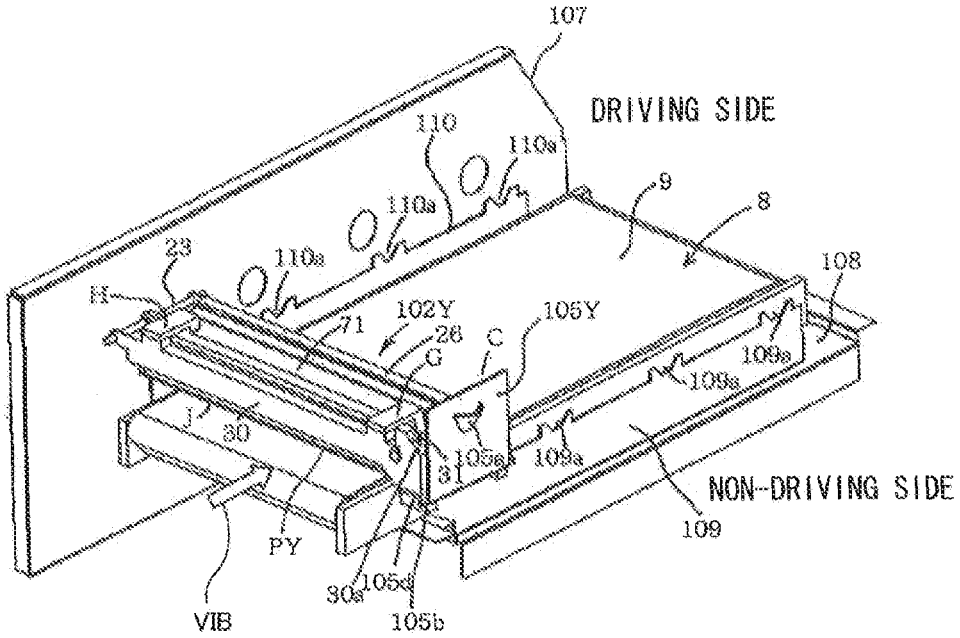
FIG. 6A is a perspective view of the cartridge mounting portion of FIG. 5A as viewed along a different direction.
Figure 6B:
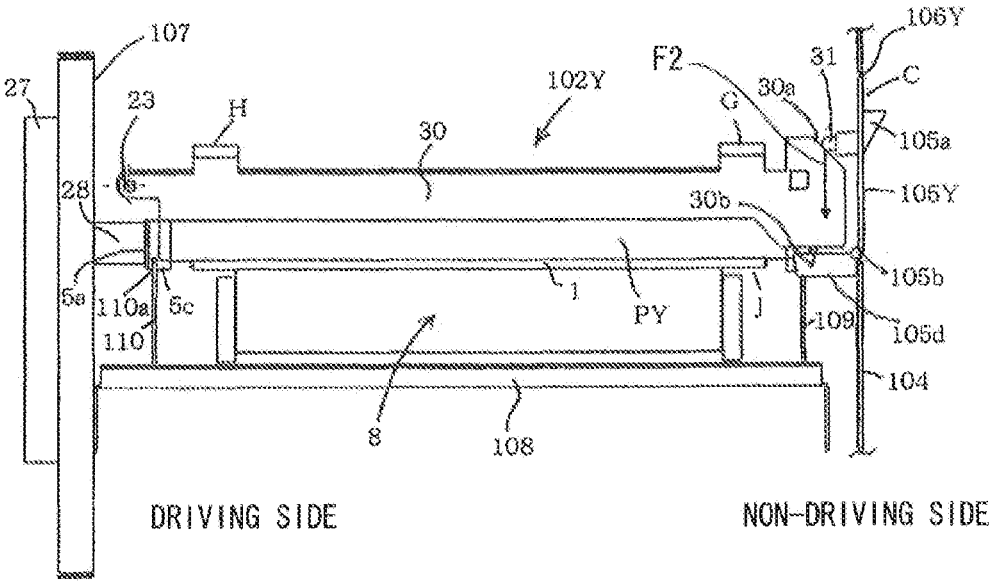
FIG. 6B illustrates the cartridge mounting portion as viewed along a direction indicated by the arrow VIB of FIG. 6A.

The mounting portions 102Y, 102M, 102C, and 102K for the cartridges PY, PM, PC, and PK of the respective colors have the same structure. In the following, only the mounting portion 102Y of the first cartridge PY is described. FIG. 5A is a perspective view of the apparatus frame from which the other cartridges and peripheral components are omitted for the purpose of emphasizing the first cartridge PY. FIG. 5B illustrates the cartridge mounting portion as viewed along a direction indicated by the arrow VB of FIG. 5A. FIG. 6A is a perspective view of the apparatus frame of FIG. 5A viewed from an opposite side, and FIG. 6B illustrates the cartridge mounting portion as viewed along a direction indicated by the arrow VIB of FIG. 6A. The unit (transfer member) 8 is arranged while being positioned on an upper surface of a middle bottom frame 108 arranged between the opening-end-side frame 104 of the main frame constituting the frame of the main body 100A of the apparatus and an inner-end-side (rear-side) frame 107. Further, on the opening-end side and the inner-end side of the upper surface of the frame 108, on both sides of the unit 8, there are arranged an opening-end-side drum holder 109 configured to support the non-driving side of each of the cartridges P and an inner-end-side drum holder 110 configured to support the driving side thereof. The holders 109 and 110 are each formed of a metal-plate member elongated in the lateral direction, and respectively provided with multiple positioning recessed portions 109*a* and 110*a* corresponding to the cartridges P at predetermined intervals on upper side portions along the longitudinal direction.

The mounting portion 102Y includes a cartridge guide (cartridge supporting member) 26 configured to detachably mount the cartridge PY substantially parallel to the rotation axial direction of the drum 1. The guide 26 is provided with a guide groove portion 26*c* (FIGS. 3A, 7A, 9A, and 9B) along the longitudinal direction. Further, the cartridge PY is provided with a protruded-thread portion Pc (FIGS. 3A, 3B, 7A, 9A, and 9B) protruded on a right side surface of the frame body 5 along the longitudinal direction. The protruded-thread portion Pc of the cartridge PY is slidably fit into the guide groove portion 26*c*, and hence the cartridge PY is detachably supported (held) substantially parallel to the rotation axial direction of the drum 1 with respect to the guide 26. The guide 26 is arranged rotatably about a rotary shaft (supporting point) 23 on a downstream side in a cartridge-insertion direction relative to the main body 100A of the apparatus. The guide 26 is rotatable about the shaft 23 so as to support the cartridge PY so that the cartridge PY can be positioned to such an image forming position J as to perform image formation and such a retracted position K (FIGS. 1 and 10B) as to be retracted away from the image forming position J. The rotary shaft 23 is held between a pair of supporting members 24 (FIGS. 3A, 7A, and 7B) arranged while being fixed to the left and right with a clearance therebetween on an inner surface side of the inner-end-side frame 107, with an axis thereof extending in the lateral direction.

Further, the mounting portion 102Y includes an array holder (light-emitting-member supporting member) 71 supporting the LED head array 6 as a light emitting member (exposure device). FIG. 8A is a perspective view of the holder 71 and a lifter 30 coupled thereto. The lifter 30 is a member parallel to the holder 71, and coupled to the holder 71 at an opening-end-side portion G and an inner-end-side portion H of the holder 71 with a predetermined clearance therebetween. The array 6 is arranged on a lower surface side of the holder 71 along a longitudinal direction of the holder so that the array 6 faces downward. The holder 71 and the lifter 30 are arranged rotatably about the rotary shaft 23 on the downstream side in the cartridge-insertion direction. The holder 71 supports the array 6 so that the array 6 can be positioned to such an exposure position M as to expose the drum 1 with light emission of the LEDs 6*a* of the array 6 and such a retracted position N (FIG. 1) as to be retracted away from the exposure position M. In a state in which the protruded-thread portion Pc of the cartridge PY is fitted into the guide groove portion 26*c* of the guide 26 so that the cartridge PY is held by the guide 26, the guide 26 is positioned on a right side of the cartridge PY. The array 6 held by the holder 71 is fitted into an exposure groove-hole portion Pd provided in an upper surface side of the cartridge PY along the longitudinal direction of the cartridge so as to face the drum 1. A driving side of the groove-hole portion Pd is opened (FIG. 7B). The lifter 30 is positioned on a left side of the cartridge PY.

(1) In a state in which the cartridge door 105Y is held at such a closing position C as to close the opening portion 106Y as illustrated in FIGS. 5A, 5B, 6A, and 6B, the guide 26 supporting the cartridge PY is substantially horizontally rotated about the shaft 23. In this state, the cartridge PY is at the image forming position J. At the image forming position J of the cartridge PY, the lower surface of the drum 1 is held in contact with the belt 9 of the unit 8 at a predetermined position so as to form the primary-transfer nip portion T1. Further, the holder 71 supporting the array 6 positions the array 6 at such an exposure position M as to expose the drum 1 with the light emission of the LEDs 6*a* in the state in which the cartridge PY is at the image forming position J.

Figure 7A:
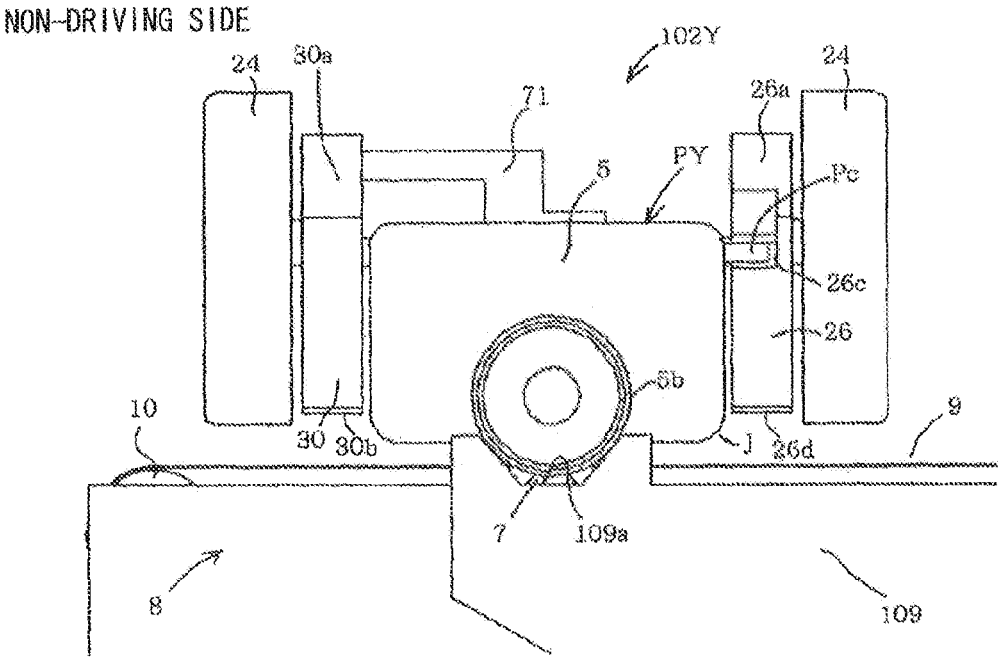
FIG. 7A is a view (a front view) showing a non-driving side of the cartridge mounted to the mounting portion.
Figure 7B:
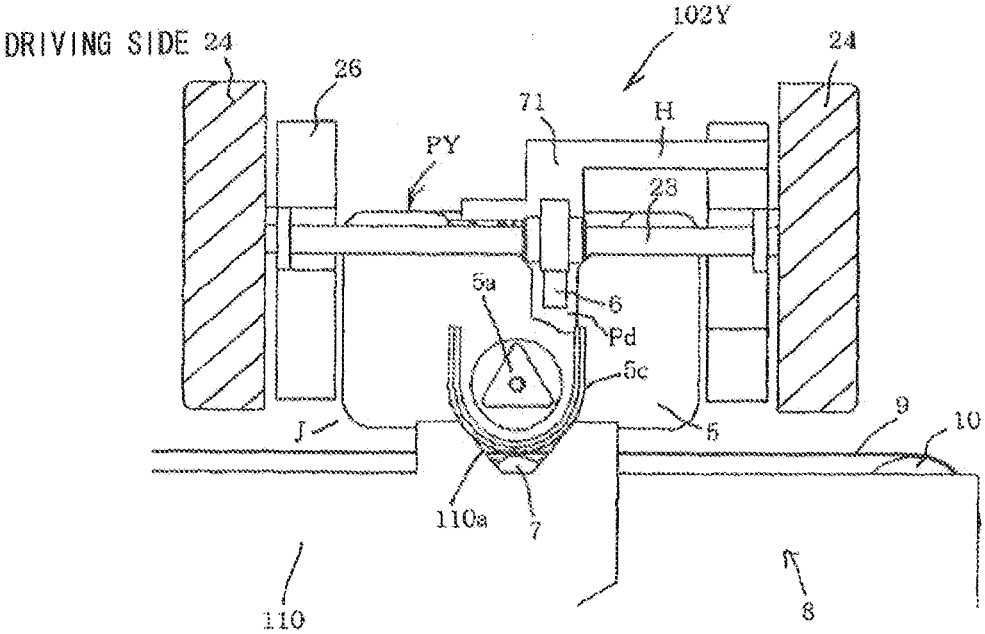
FIG. 7B is a view (a rear view) showing a driving side of the cartridge mounted to the mounting portion.
Figure 8A:
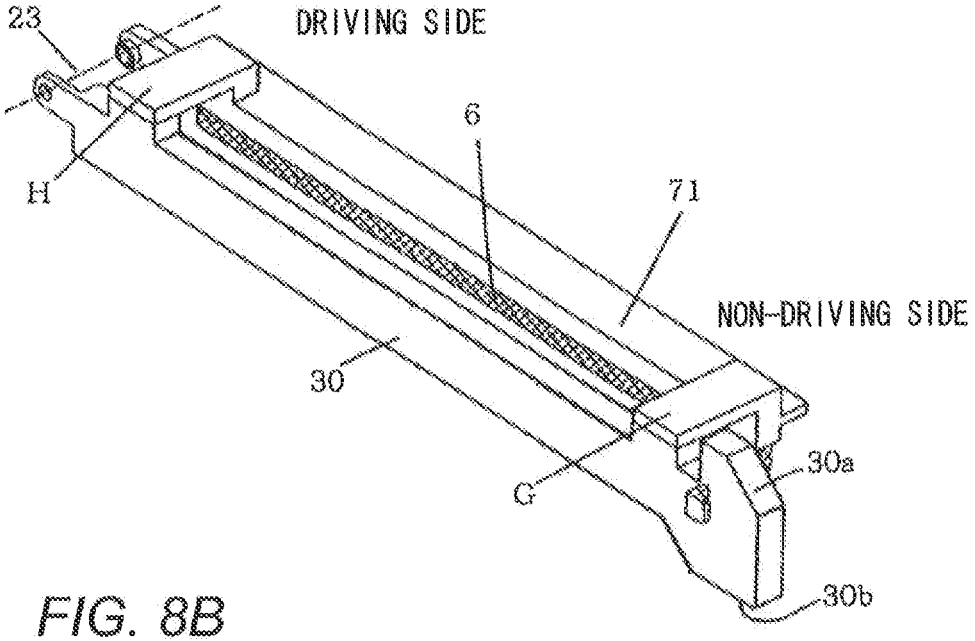
FIG. 8A is an external perspective view of an assembly of a holder holding an array, and a lifter.
Figure 8B:
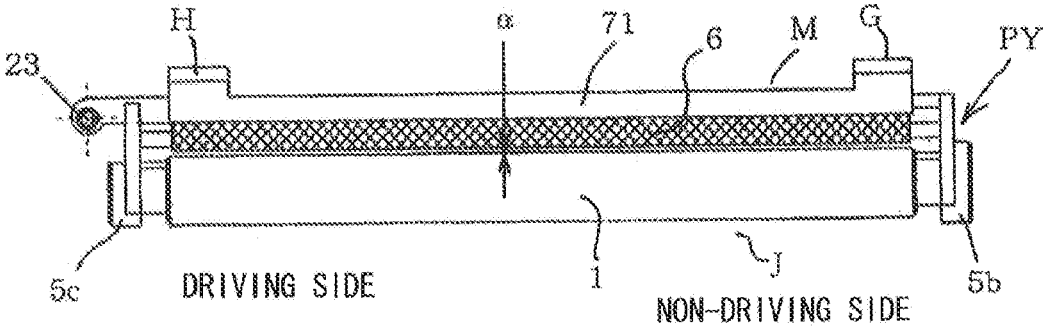
FIG. 8B is an explanatory diagram of an exposure position of the array.
Figure 8C:
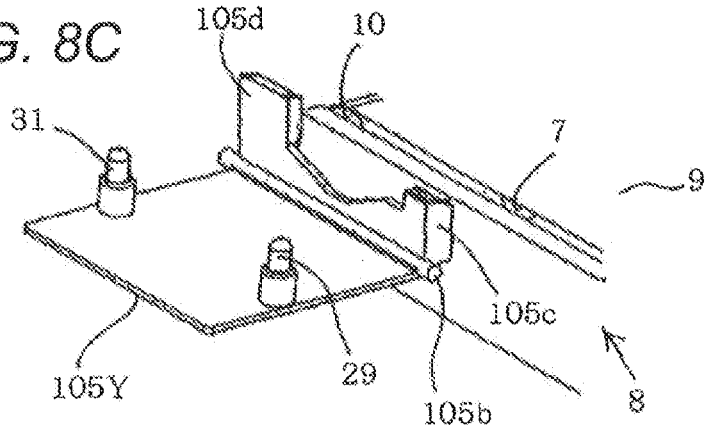
FIG. 8C is a structural explanatory diagram of the cartridge door.

As illustrated in FIGS. 7A and 7B, positioned portions 5*b* and 5*c* on the non-driving side and the driving side of the cartridge PY at the image forming position J are engaged respectively with the positioning recessed portion 109*a* of the opening-end-side drum holder 109 and the positioning recessed portion 110*a* of the inner-end-side drum holder 110. Each of the positioned portions 5*b* and 5*c* is an annular portion or a circular-arc portion coaxial with the rotation axis of the drum 1. As illustrated in FIG. 8C, a cartridge-guide-pressing member 29 and a lifter-pressing member 31 are provided on an inner surface side of the door 105Y. In a state in which the door 105Y is held at such a closing position C as to close the opening portion 106Y, an urging member (not shown) exerts a force in a downward F1 direction (FIG. 5B) from the member 29 onto a slope portion 26*a* on an opening-end side of the guide 26. The guide 26 having received the force in the F1 direction receives a downward rotating force about the shaft 23, and accordingly to the protruded-thread portion Pc of the cartridge PY is pressed by the guide groove portion 26*c*. With this, the positioned portion 5*b* on the non-driving side of the cartridge PY is reliably pressed into the recessed portion 109*a* on a holder-109 side (FIG. 7A). Further, the positioned portion 5*c* on the driving side of the cartridge PY is reliably pressed into the recessed portion 110*a* on a holder-110 side (FIG. 7B). A magnitude of the force F1 at this time is set to have a value sufficient for preventing vibration of the drum 1 at the time of image formation. With this structure, the cartridge PY is positioned to the image forming position J, and stably held thereat. Further, the drum gear 28 of the driving unit 27 on the main body 100A side of the apparatus is coupled to the drive input portion 5*a* on the driving side of the cartridge PY positioned at the image forming position J (FIGS. 5B and 6B). Further, the bias output portion (not shown) on the main body 100A side of the apparatus is in such a state as to be coupled to the bias input portion (not shown) on the cartridge-P side.

Figure 9A:
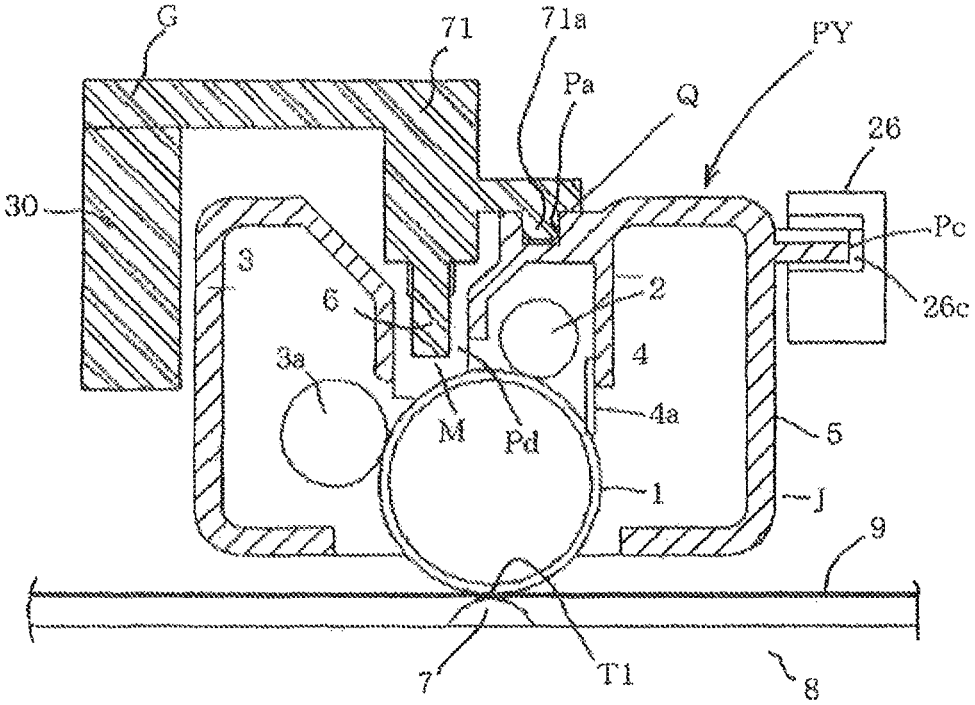
FIG. 9A is an explanatory diagram of the cartridge at an image forming position and the array at the exposure position.
Figure 9B:
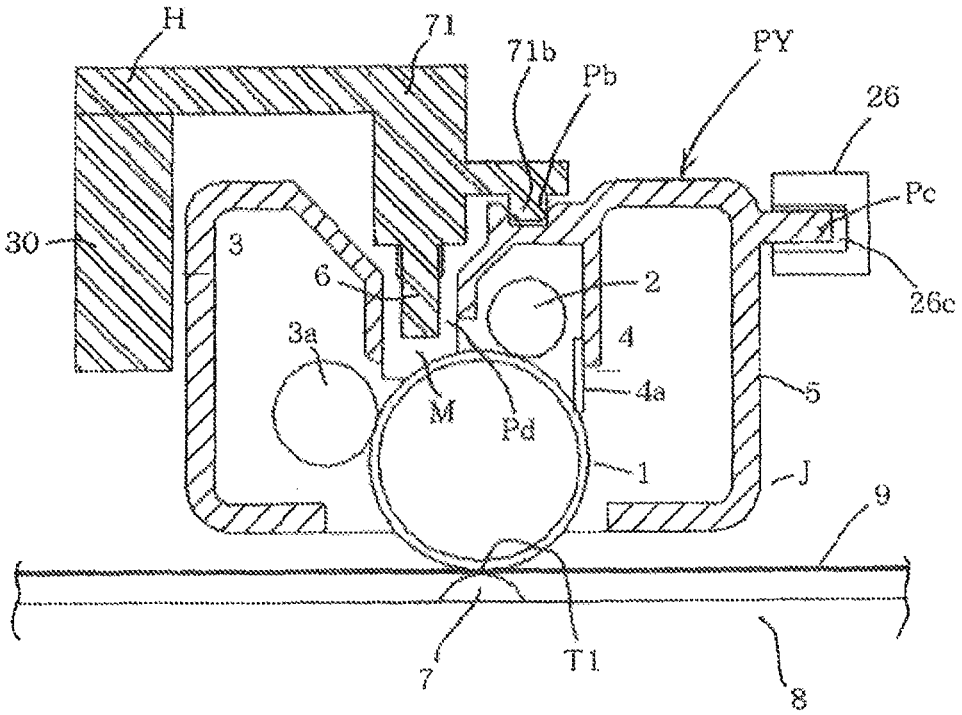
FIG. 9B is an explanatory diagram of the cartridge at an image forming position and the array at the exposure position.

Meanwhile, as illustrated in FIGS. 9A and 9B, the holder 71 supporting the array 6 is in such a state that a positioning boss 71*a* on the opening-end side is inserted in an opening-end-side groove portion Pa on the cartridge PY, and that a positioning boss 71*b* on the inner-end side is inserted in an inner-end-side groove portion Pb on the cartridge PY. With this, the holder 71 is positioned with respect to a moving direction of the belt 9 orthogonal to the rotation axial direction of the drum 1. In the state in which the door 105Y is held at such a closing position C as to close the opening portion 106Y, an urging member (not shown) exerts a force in a downward F2 direction (FIG. 6B) from the member 31 onto a slope portion 30*a* on an opening-end side of the lifter 30. The lifter 30 having received the force in the F2 direction receives a downward rotating force about the shaft 23. Simultaneously, the holder 71 integrated with the lifter 30 also receives the downward rotating force. As a result, an inner surface (ground surface) Q near the boss 71*a* on the opening-end side is brought into contact with the upper surface of the cartridge PY in such a state as to be pressed against the same, and then the holder 71 is positioned with respect to the cartridge PY positioned and held at the image forming position J (FIG. 9A). With this, the array 6 supported by the holder 71 is held in such a state as to be positioned to such an exposure position M as to expose the drum 1 with the light emission of the LEDs 6*a*. A magnitude of the force F2 at this time is set to have a value sufficient for preventing the array 6 from vibrating with respect to the drum 1 at the time of image formation. FIG. 8B illustrates a positional relation of the drum 1 of the cartridge PY positioned at the image forming position J and the array 6 positioned at the exposure position M. The array 6 is set to have a predetermined focal length α with respect to the drum 1 so as to render an electrostatic latent image on the drum 1. That is, the holder 71 supporting the array 6 positions the array 6 to such an exposure position M that the drum 1 is exposed with the light emission of the LEDs 6*a* in the state in which the cartridge PY is at the image forming position J.

Figure 10A:
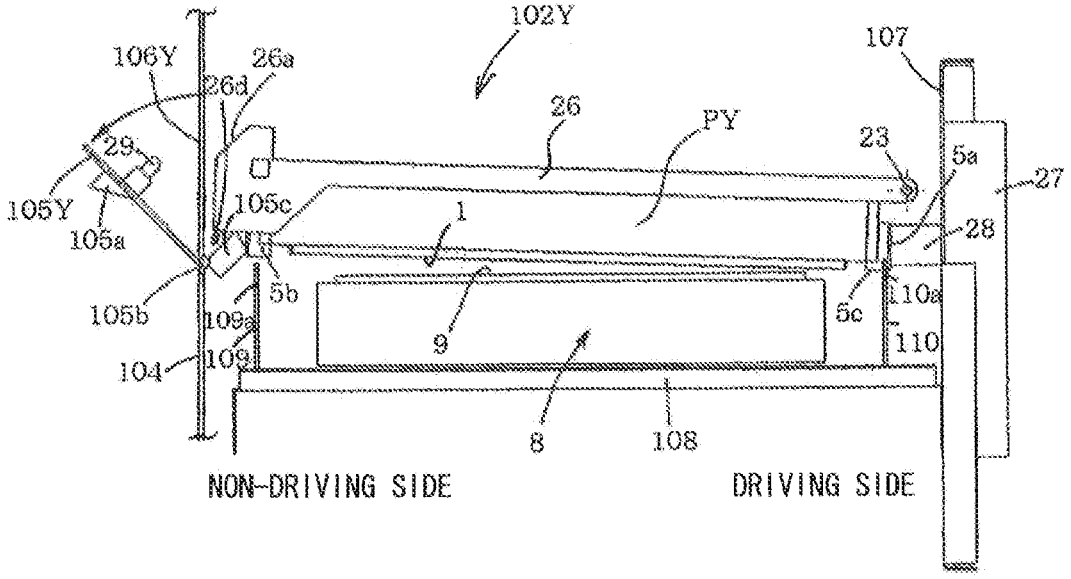
FIG. 10A is a diagram illustrating interlock of the cartridge door and a guide.
Figure 10B:
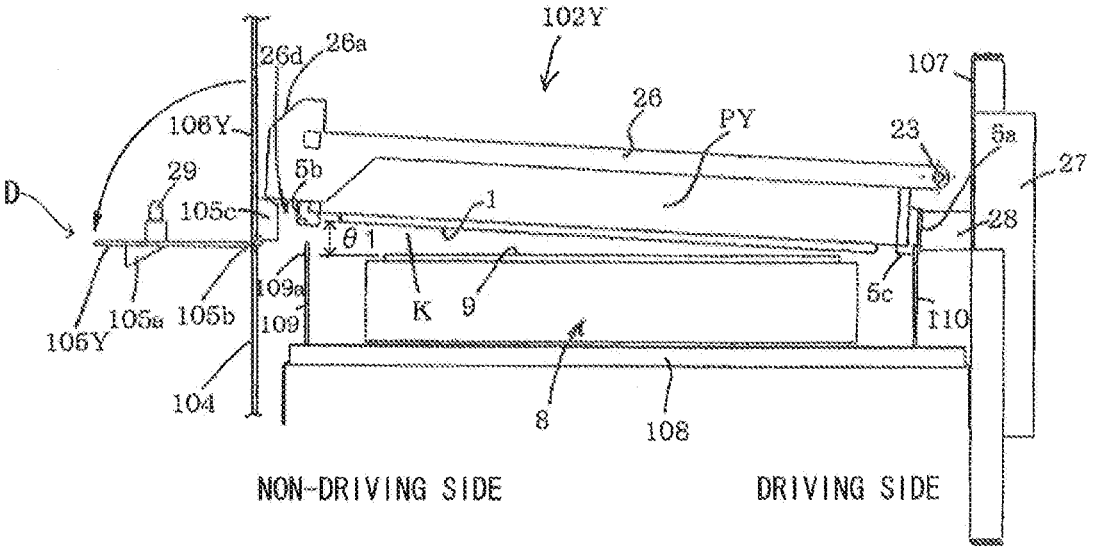
FIG. 10B is a diagram illustrating interlock of the cartridge door and a guide.
Figure 11A:
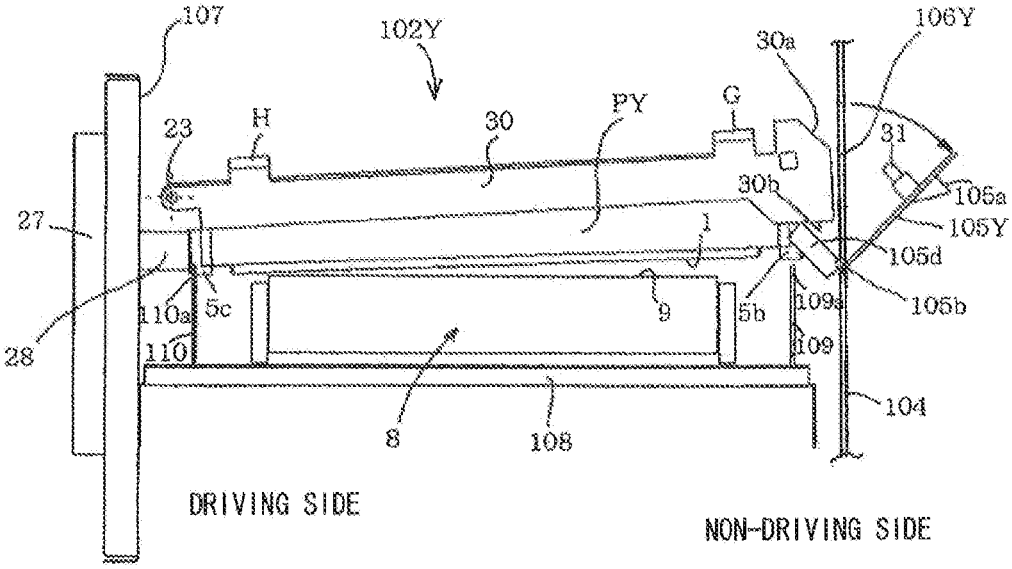
FIG. 11A is a diagram illustrating interlock of the cartridge door and the lifter (holder).
Figure 11B:
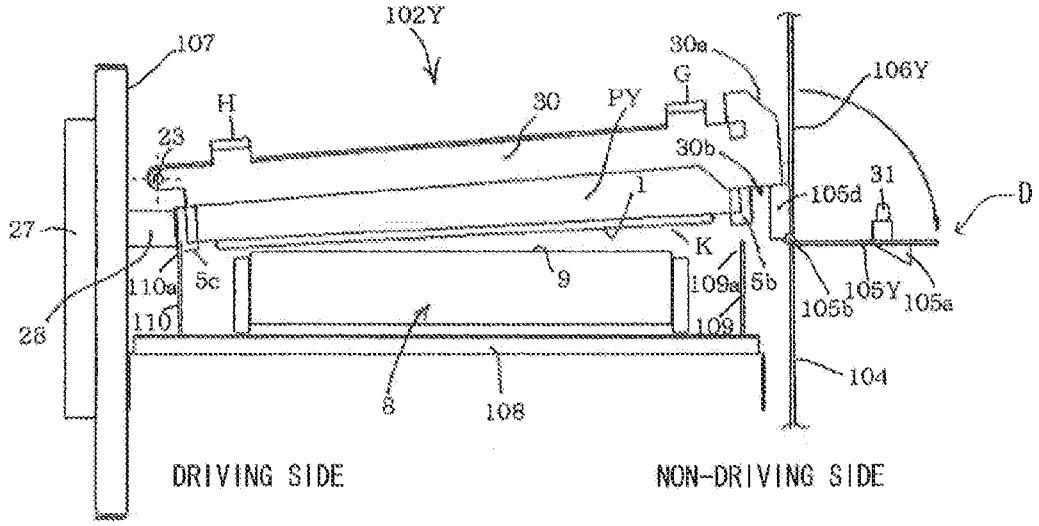
FIG. 11B is a diagram illustrating interlock of the cartridge door and the lifter (holder).

(2) Next, a case where the door 105Y is rotated by the user from the closing position C (first operating position) of FIG. 4A to the opening position D (second operating position) of FIG. 4B will be described. FIG. 10A illustrates a state in which the door 105Y at the closing position C is in the middle of being opened in FIG. 5B. FIG. 10B illustrates a state in which the door 105Y is sufficiently opened to be positioned at the opening position D. FIG. 11A illustrates a state in which the door 105Y at the closing position C is in the middle of being opened in FIG. 6B. FIG. 11B illustrates a state in which the door 105Y is sufficiently opened to be positioned at the opening position D. In association with the rotating operation of the door 105Y from the closing position C to the opening position D, the guide 26 is rotated about the shaft 23 in a direction away from the belt 9 so that the cartridge PY is moved from the image forming position J to the retracted position K. Then, in a state in which the door 105Y has been pivoted to the opening position D, the cartridge PY is held to enter a state in which the cartridge PY is inclined at an angle θ1 with respect to the belt 9 as a result of the above-mentioned rotating of the guide 26. Further, in association with the pivotal operation of the door 105Y from the closing position C to the opening position D, the holder 71 is rotated about the shaft 23 in a direction away from the belt 9 so that the array 6 is moved from the exposure position M to the retracted position N. Then, the array 6 is held to enter a state in which the array 6 is inclined at an angle θ2 with respect to the belt 9 as a result of the above-mentioned rotating of the holder 71. In this case, the above-mentioned angles θ1 and θ2 are set to establish a relation of $\theta 1<\theta 2$.

The above-mentioned movement of the guide 26 and the holder 71 will be described in more detail. At an early stage of the opening pivotal process of the door 105Y, the members 29 and 31 on a door-105Y side are separated respectively from the slope portion 26*a* on the opening-end side of the guide 26 and the slope portion 30*a* on the opening-end side of the lifter 30. With this, the guide 26 and the lifter 30 are released from being pressed in (restrained) by the members 29 and 31, and hence freely rotated upward about the shaft 23. Further, a first cam portion (interlocking member) 105*c* and a second cam portion (interlocking member) 105*d* which are provided integrally with the door 105Y on a lower side of the door 105Y are brought into contact respectively with a lower surface part 26*d* on the opening-end side of the guide 26 and a lower surface part 30*b* on the opening-end side of the lifter 30. In an additional opening pivotal process of the door 105Y, the opening-end side of the guide 26 is lifted up by the gradually rising first cam portion 105*c* so as to be rotated upward from the belt 9 about the shaft 23. With this, the cartridge PY held by the guide 26 also starts to be inclined while being separated from the drum holders 109 and 110. As a result, the drum 1 in the cartridge PY starts to be separated from the belt 9 (FIG. 10A). Then, in a state in which the door 105Y is at the opening position D, the guide 26 is held in such a state that the opening-end side thereof is sufficiently lifted up by an amount of a predetermined rising height of the first cam portion 105*c*.

Figure 1:
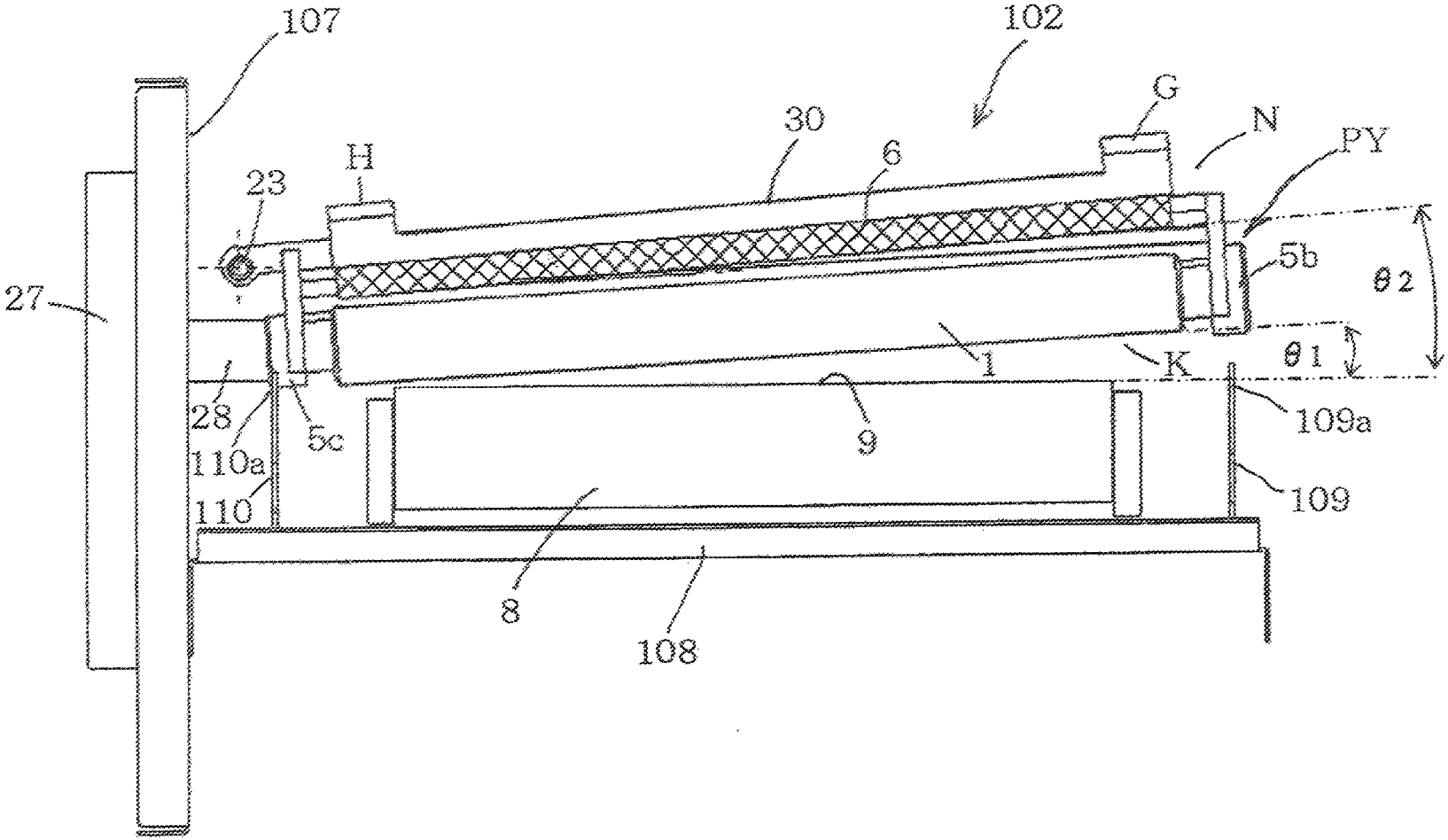
FIG. 1 best illustrates a structure of the present invention.

As a result of this rotating of the guide 26, the cartridge PY is held (retracted position K) to enter a state in which the cartridge PY is inclined at the angle θ1 with respect to the belt 9 (FIGS. 1 and 10B). In this embodiment, θ1 is set to be equal to 3°. Further, in the opening pivotal process of the door 105Y, the opening-end side of the lifter 30 is also lifted up by the gradually rising second cam portion 105*d* so as to be rotated upward from the belt 9 about the shaft 23. A rising height of the second cam portion 105*d* is set to be higher than the rising height of the first cam portion 105*c* by a predetermined amount. With this, the holder 71 integrated with the lifter 30 also starts to be inclined while being separated from the cartridge PY. Then, in a state in which the door 105Y is at the opening position D, the lifter 30 is held in such a state that the opening-end side thereof is sufficiently lifted up by an amount of a predetermined rising height of the second cam portion 105*d*. As a result of this rotating of the lifter 30, the array 6 held by the holder 71 integrated with the lifter 30 is held (retracted position N) to enter a state in which the array 6 is inclined at the angle θ2 with respect to the belt 9 (FIGS. 1 and 11B). In this embodiment, θ2 is set to be equal to 4.5°.

In order to remove the cartridge PY from the mounting portion 102Y, in the above-mentioned state, the non-driving side of the cartridge PY is gripped and pulled to the opening-end side, to thereby move the cartridge PY to the non-driving side facing the opening portion 106Y. The protruded-thread portion Pc of the cartridge PY is slidably fit into the guide groove portion 26*c*, and hence the cartridge PY is detachably supported substantially parallel to the rotation axial direction of the drum with respect to the guide 26. Accordingly, by being pulled to the opening-end side while being slidably moved along the guide 26, the cartridge PY can be detached from the mounting portion 102Y to an outside of the main body 100A of the apparatus through the opening portion 106Y. As described above, when the door 105Y is opened, the cartridge PY is inclined about the rotary shaft 23 at the angle θ1 with respect to the belt 9, and the array 6 is inclined about the rotary shaft 23 at the angle θ2 with respect to the belt 9. In this context, θ2 is set to be larger than θ1, and hence the drum 1 enters a state (retracted position K) in which the drum 1 is separated from the belt 9. Further, the array 6 is in such a state as to have moved to the retracted position N away from the exposure position M with respect to the drum 1. As long as the door 105Y is opened in order to detach the cartridge PY, the cartridge PY can be detached without interference with the belt 9 or the array 6 while being held by the guide groove portion 26*c* of the guide 26 (FIG. 4B).

(3) A mounting procedure of the cartridge PY with respect to the mounting portion 102Y is reverse to the procedure and movement in the above-mentioned detaching procedure. In a state in which the door 105Y is opened to the opening position D, the cartridge PY is inserted from the driving side thereof into the main body 100A of the apparatus through the opening portion 106Y. An inner-end side of the protruded-thread portion Pc of the cartridge PY is fitted to the opening-end side of the guide groove portion 26*c* of the guide 26 in such a state that the opening-end side thereof is lifted up by the first cam portion 105*c*. Then, the cartridge PY is pushed into the inner-end side while being slidably moved along the guide 26. As a result of being sufficiently pushed in, the cartridge PY interferes with a stopper (not shown), and hence further push-in movement is hindered. At the time of push-in movement of the cartridge PY, the drum 1 enters a state in which the drum 1 is separated from the belt 9, and the array 6 in such a state as to have moved to the retracted position N away from the exposure position M with respect to the drum 1. With this, the drum 1 is inserted into the main body 100A of the apparatus without interference with the belt 9 or the array 6.

Then, the door 105Y is pivoted from the opening position D to the closing position C. According to closing pivotal process of the door 105Y, the opening-end side of the guide 26 is lowered down by the first cam portion 105*c* so as to be rotated toward the belt 9 about the shaft 23 into the substantially horizontal state, the first cam portion 105*c* being rotated in a manner of being gradually put down. With this, the positioned portions 5*b* and 5*c* on the non-driving side and the driving side of the cartridge PY held by the guide 26 are engaged respectively with the positioning recessed portion 109*a* of the opening-end-side drum holder 109 and the positioning recessed portion 110*a* of the inner-end-side drum holder 110. According to closing pivotal process of the door 105Y, the opening-end side of the lifter 30 is also lowered down by the second cam portion 105*d* so as to be rotated toward the belt 9 about the shaft 23, the second cam portion 105*d* being rotated in a manner of being gradually put down. With this, the positioning boss 71*a* on the opening-end side of the holder 71 integrated with the lifter 30 is inserted in the opening-end-side groove portion Pa on the cartridge PY, and the positioning boss 71*b* on the inner-end side thereof is inserted in the inner-end-side groove portion Pb on the cartridge PY. In the state in which the door 105Y is held at the closing position C, the urging member exerts the force in the downward F1 direction (FIG. 5B) from the member 29 onto the slope portion 26*a* on the opening-end side of the guide 26. Further, the urging member exerts the force in the downward F2 direction (FIG. 6B) from the member 31 onto the slope portion 30*a* on the opening-end side of the lifter 30. In the above-mentioned state, the cartridge PY is positioned at the image forming position J and held thereat. Further, the holder 71 supporting the array 6 positions the array 6 at such an exposure position M as to expose the drum 1 with light emission of the LEDs 6*a* (FIG. 17) in the state in which the cartridge PY is at the image forming position J. Still further, the drum gear 28 of the driving unit 27 on the main body 100A side of the apparatus is coupled to the drive input portion 5*a* on the driving side of the cartridge PY positioned at the image forming position J. Yet further, the bias output portion on the main body 100A side of the apparatus is in such a state as to be coupled to the bias input portion on the cartridge-P side.

Meanwhile, as illustrated in FIGS. 9A and 9B, the holder 71 supporting the array 6 is in such a state that the positioning boss 71*a* on the opening-end side is inserted in the opening-end-side groove portion Pa on the cartridge PY, and that the positioning boss 71*b* on the inner-end side is inserted in the inner-end-side groove portion Pb on the cartridge PY. With this, the holder 71 is positioned with respect to the moving direction of the belt 9 orthogonal to the rotation axial direction of the drum 1. In the state in which the door 105Y is held at such a closing position C as to close the opening portion 106Y, the urging member (not shown) exerts the force in the downward F2 direction (FIG. 6B) from the member 31 onto the slope portion 30*a* on the opening-end side of the lifter 30. The lifter 30 having received the force in the F2 direction receives the downward rotating force about the shaft 23. Simultaneously, the holder 71 integrated with the lifter 30 also receives the downward rotating force. As a result, the inner surface (ground surface) Q near the boss 71*a* on the opening-end side is brought into contact with the upper surface of the cartridge PY in such a state as to be pressed against the same, and then the holder 71 is positioned with respect to the cartridge PY positioned and held at the image forming position J (FIG. 9A). With this, the array 6 supported by the holder 71 is held in such a state as to be positioned to such an exposure position M as to expose the drum 1 with the light emission of the LEDs 6*a*. The magnitude of the force F2 at this time is set to have the value sufficient for preventing the array 6 from vibrating with respect to the drum 1 at the time of image formation. FIG. 8B illustrates the positional relation of the drum 1 of the cartridge PY positioned at the image forming position J and the array 6 positioned at the exposure position M. The array 6 is set to have the predetermined focal length α with respect to the drum 1 so as to render an electrostatic latent image on the drum 1. That is, the holder 71 supporting the array 6 positions the array 6 to such an exposure position M that the drum 1 is exposed with the light emission of the LEDs 6*a* in the state in which the cartridge PY is at the image forming position J.

As described above, the cartridge PY can be inserted only by the operations reverse to those in the above-mentioned detaching procedure. The interlocking structure of the door 105Y, the guide 26, and the lifter 30 prevents interference of the drum 1 with the belt 9 or the array 6 from the start to completion of the insertion. Then, when the door 105Y is closed, the cartridge PY and the array 6 are arranged at predetermined positions at the time of image formation. Lastly, the door 103 is closed to the closing position A. With this, the door switch is turned on, and the power supply circuit of the apparatus 100 is maintained in the closed state. In this manner, the apparatus 100 enters such a state as to be capable of the image forming operation.

Only the case of the first cartridge PY has been described above, but the other second to fourth cartridges PM, PC, and PK are replaced in the similar way.

As described hereinabove, in this embodiment, the cartridge P is mounted and detached substantially parallel to the rotation axial direction of the drum 1. Simultaneously, the drum 1 enters such a state as to be separated from the belt 9, and the array 6 enters such a state as to be spaced away from the position with respect to the drum 1 at the time of image formation. Thus, the cartridge P can be mounted and detached without interfering with the belt 9 or the array 6. In other words, the array may be spaced away from the cartridge P inside the apparatus main body. In addition, the array 6 is not exposed to dust in the outside air. As a result, a highly reliable image forming apparatus with no fouling of the array 6 is attained. Further, the array 6 cannot be touched by an operator, and hence the operator does not need to pay attention to the array 6 when replacing the cartridge P. As a result, an image forming apparatus having high operability is attained. Still further, interlocking of a series of operations with use of the cartridge door 105 leads to space-saving of an interlocking mechanism in a front side portion of the apparatus, which contributes to downsizing of a product. Here, in the apparatus structure, an operation member is not limited to the door 105, and may include a lever member separately arranged.

The above-mentioned embodiment is summarized as follows. The electrophotographic image forming apparatus 100 forms an image on the recording medium S in the state in which the process cartridge P including the electrophotographic photosensitive drum 1 is detachably mounted to the main body 100A of the apparatus of the electrophotographic image forming apparatus 100. The electrophotographic image forming apparatus 100 includes the cartridge supporting member 26 configured to detachably mount the cartridge P substantially parallel to the rotation axial direction of the drum 1. The supporting member 26 is arranged rotatably about the supporting point on the downstream side in the process-cartridge-insertion direction with respect to the main body 100A of the apparatus. The supporting member 26 supports the cartridge P so that the cartridge P can be positioned to such an image forming position J as to perform image formation and such a retracted position K as to be retracted away from the image forming position J. Further, the electrophotographic image forming apparatus 100 includes the light emitting member 6 including the multiple light emitting elements which are provided side-by-side in the rotation axial direction of the drum 1 and emit light for exposing the drum 1 according to image information in the state in which the cartridge P is at the image forming position J. Still further, the electrophotographic image forming apparatus 100 includes the light-emitting-member supporting member 71 arranged rotatably about the supporting point 23 on the downstream side in the process-cartridge-insertion direction with respect to the main body 100A of the apparatus and supporting the light emitting member 6. The supporting member 71 supports the light emitting member 6 so that the light emitting member 6 can be positioned to such an exposure position M as to expose the drum 1 with the light emission of the light emitting elements and such a retracted position N as to be retracted away from the exposure position M. Further, the electrophotographic image forming apparatus 100 includes the transfer member 8 configured to transfer a toner image formed on the drum 1 onto the recording medium S in the state in which the cartridge P is at the image forming position J, the transfer member 8 being positioned in the main body 100A of the apparatus. Still further, the electrophotographic image forming apparatus 100 includes the operation member 105 operated by a user when the user pushes in and pulls out the cartridge P from the main body 100A of the apparatus, the operation member 105 being capable of being positioned to the first operating position C and the second operating position D. The operation member 105 includes the interlocking members 105*c* and 105*d* in association with the operation of the operation member 105. In association with the operation member 105 operated from the second operating position D to the first operating position C, the interlocking members 105*c* and 105*d* rotate the supporting member 26 about the supporting point 23 so that the cartridge P is positioned to the image forming position J. Further, the light-emitting-member supporting member 71 is rotated about the supporting point 23 so that the light emitting member 6 is positioned to the exposure position M. In association with the operation member 105 operated from the first operating position C to the second operating position D, the supporting member 26 is rotated about the supporting point 23 by the interlocking members 105*c* and 105*d* in a direction away from the transfer member 8 so that the cartridge P is positioned to the retracted position K. With this, the cartridge P is held to enter a state in which the cartridge P is inclined at the angle θ1 with respect to the transfer member 8. Further, the supporting member 71 is rotated about the supporting point 23 in a direction away from the transfer member 8 so that the light emitting member 6 is positioned to the retracted position N. With this, the light emitting member 6 is held to enter a state in which the light emitting member 6 is inclined at the angle θ2 with respect to the transfer member 8. Note that, the relation between the angles θ1 and θ2 is $\theta 1<\theta 2$.

In the above-mentioned structure, the cartridge P can be mounted and detached from the main body 100A of the apparatus without interfering with the transfer member 8, and the cartridge P can be mounted and detached from the main body 100A of the apparatus without interfering with the light emitting member 6.

Further, according to this embodiment, when the cartridge P is mounted and detached from the apparatus main body, the cartridge P is retracted away from the transfer member 8, and the light emitting member 6 is retracted away from the cartridge P, inside the apparatus main body. With this, the light emitting member 6 is not exposed to dust in the outside air. As a result, a highly reliable electrophotographic image forming apparatus with no fouling of the light emitting member 6 is attained. Further, the light emitting member 6 cannot be touched by a user, and hence the user does not need to pay attention to the light emitting member 6 when replacing the cartridge P. As a result, an electrophotographic image forming apparatus having high operability is attained.

Still further, the operation member 105 is an openable and closable member with respect to the opening portion 106 provided in the main body 100A of the apparatus so that the cartridge P is pushed in and pulled out of the main body 100A of the apparatus. The operation member 105 is movable between such a first operating position C as to close the opening portion and such a second operating position D as to open the opening portion. With this, such an efficient structure can be provided that the cartridge P is retracted away from the transfer member 8 through the cartridge supporting member 26 in association with the opening operation of the openable and closable member 105, and the light emitting member 6 is retracted away from the cartridge P in association with the opening operation of the openable and closable member 105. In this apparatus structure, the operation member 105 may include a lever member arranged separately from the above-mentioned openable and closable member 105.

Embodiment 2

Next, Embodiment 2 will be described. The image forming operation and the conveyance process of the recording material S in the image forming apparatus are the same as those in Embodiment 1, and hence redundant description thereof is omitted. Further, the same parts as those in Embodiment 1, such as structures of the guide 26 and the cartridge P which are inclined in association with the cartridge door 105, are described while denoted by the same reference symbols, and hence redundant description thereof is omitted.

Figure 12A:
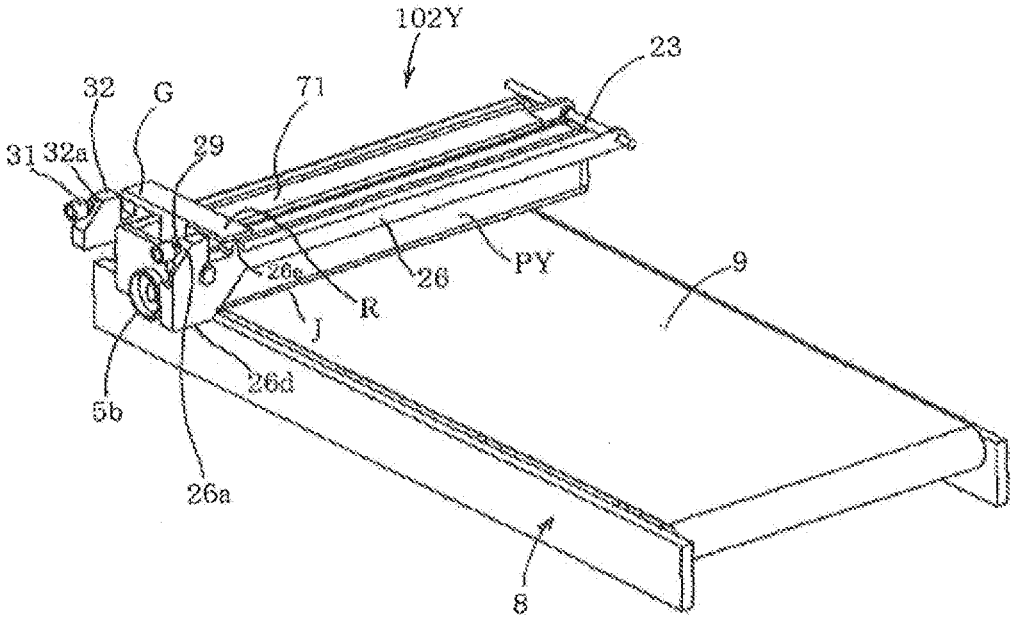
FIG. 12A is an explanatory diagram of the cartridge mounting portion in the image forming apparatus
Figure 12B:
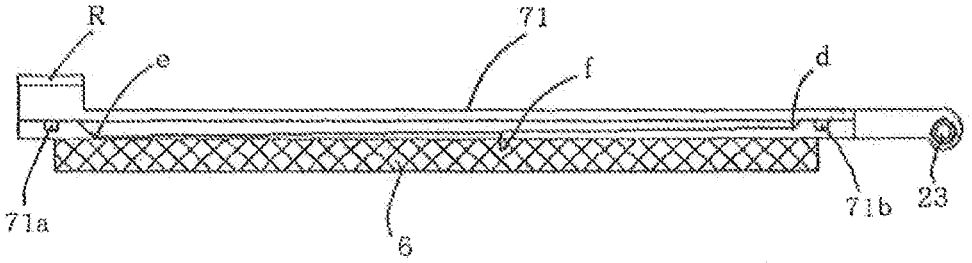
FIG. 12B is a diagram illustrating a structure of the holder holding the array.
Figure 13A:
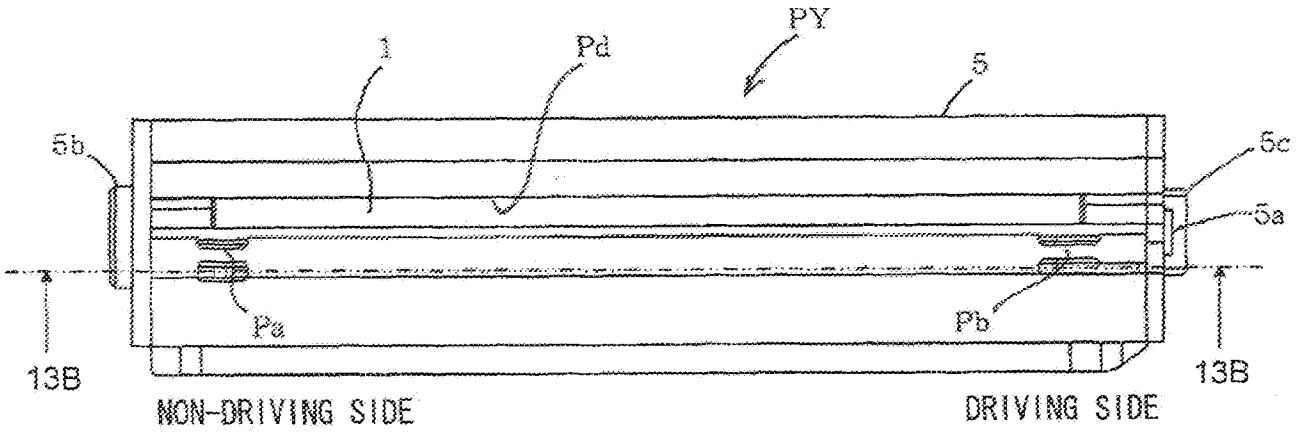
FIG. 13A is a plan view of the process cartridge in the image forming apparatus.
Figure 13B:
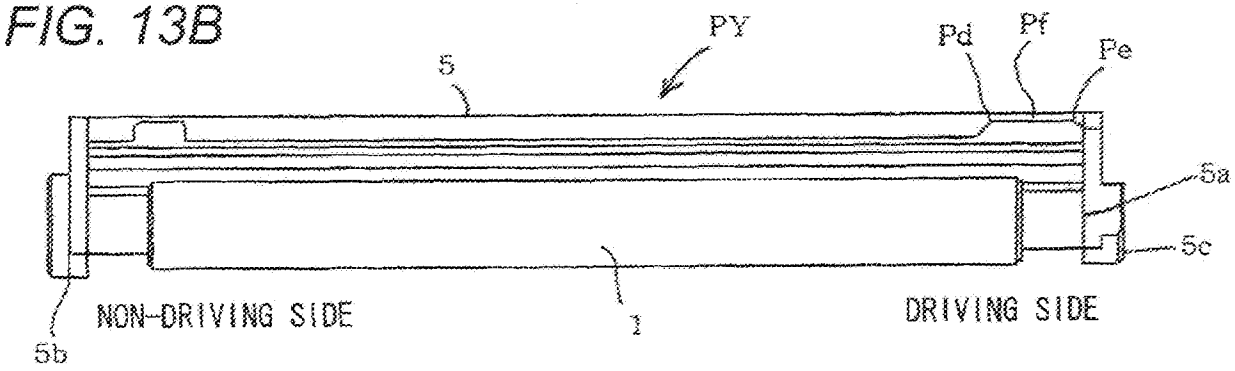
FIG. 13B is a sectional view taken along the line 13B-13B of FIG. 13A.
Figure 14A:
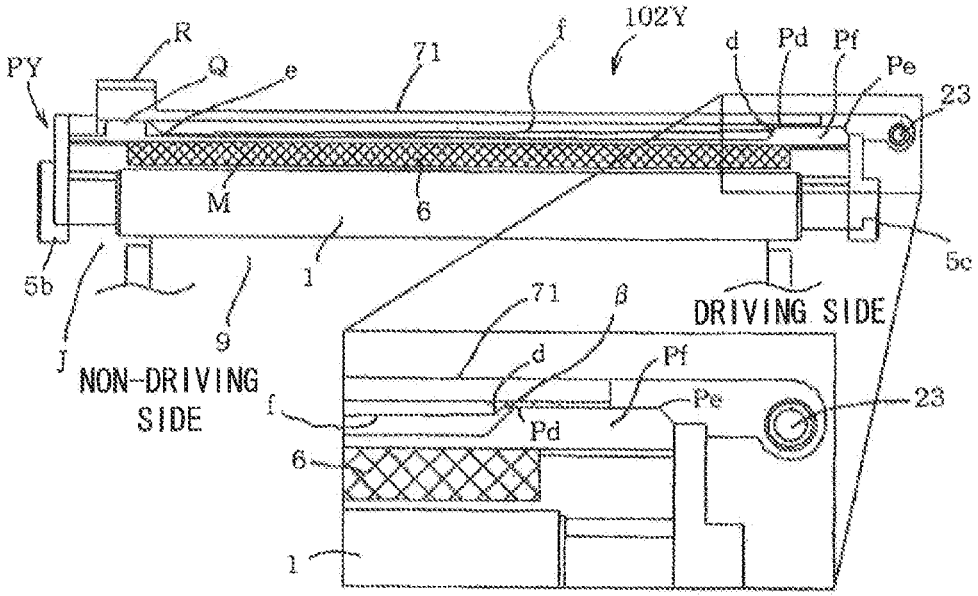
FIG. 14A is an explanatory diagram of a rotating operation of the guide holding the process cartridge.
Figure 14B:
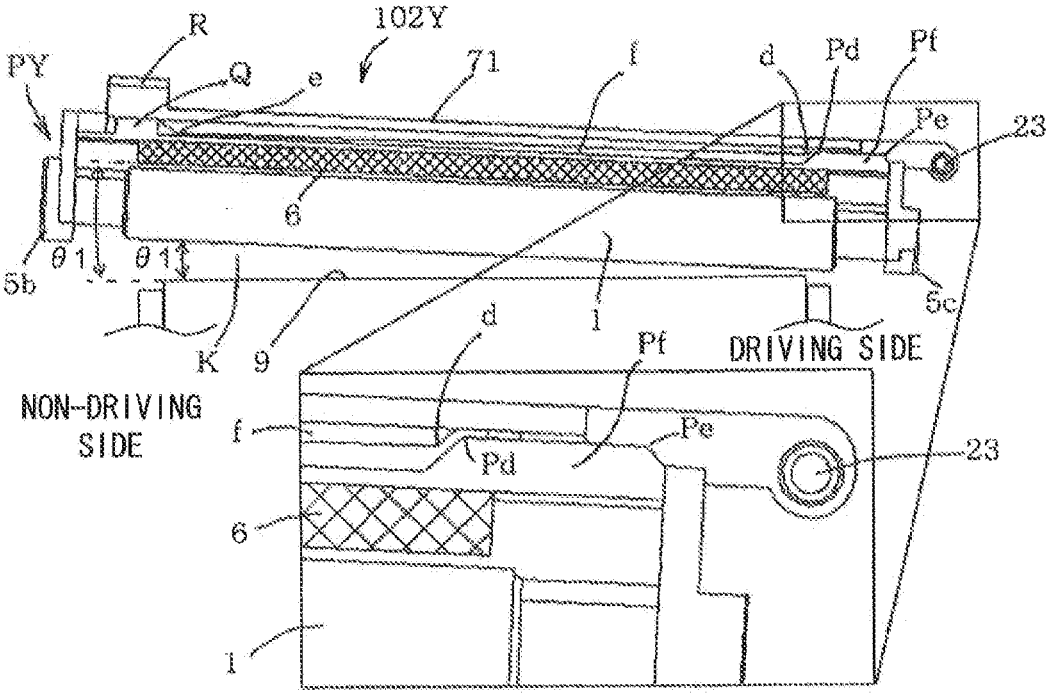
FIG. 14B is an explanatory diagram of a rotating operation of the guide holding the process cartridge.

FIG. 12A is a schematic perspective view of the cartridge PY at the time of image formation and peripheral components thereof, in which the cartridge door 105Y is omitted for the sake of convenience in illustration. A left-side jetty portion G and a right-side jetty portion R are provided on an upper surface on the opening-end side of the holder 71 holding the array 6, and a pressed member 32 is integrally attached to the left-side jetty portion G. In a state in which the door 105Y is closed, an urging member (not shown) causes the pressing member 31 on the inner surface side of the door 105Y to exert a force in a downward direction onto a slope portion 32*a* on an opening-end side of the pressed member 32 (similar to FIG. 6B). With this, the holder 71 is held in contact with the cartridge PY through the inner surface (ground surface) Q in the vicinity of the boss 71*a* illustrated in FIG. 9A. Meanwhile, the right-side jetty portion R of the holder 71 faces a projecting portion 26*e* provided on the upper surface on the opening-end side of the guide 26 with a predetermined gap therebetween. FIG. 12B is a right-side view of the holder 71 holding the array 6. The holder 71 is supported rotatably about the shaft 23, and has a downward slope portion "f" connecting a point "d" on the inner-end side and a point "e" on the opening-end side along the longitudinal direction. FIG. 13A is a top view of the cartridge PY, and FIG. 13B is a sectional view taken along the line L-L of FIG. 13A. The cartridge PY has a protruding portion Pf formed of points Pd and Pe. The above-mentioned slope portion "f" on a holder-71 side and the above-mentioned protruding portion Pf on the cartridge-P side are mutual interference members arranged respectively on the holder 71 and the cartridge P. FIG. 14A illustrates a positional relation of the slope portion "f" of the holder 71 and the protruding portion Pf of the cartridge PY at the time of image formation; specifically, a predetermined gap β is formed between the points Pd and Pe of the cartridge PY and the point "d" of the holder 71. FIG. 14B illustrates an attitude in the state in which the door 105Y is opened to the opening position, that is, an attitude prior to the detachment of the cartridge PY from the main body 100A of the apparatus. Similarly to Embodiment 1, the guide 26 is inclined in association with the opening operation of the door 105Y (FIG. 10B). The protruded-thread portion Pc of the cartridge PY is slidably fitted into the guide groove portion 26*c*, and hence the cartridge PY is detachably supported substantially parallel to the rotation axial direction of the drum with respect to the guide 26. Therefore, the drum 1 is similarly inclined so as to form the angle θ1 with respect to the belt 9. Further, the holder 71 is rotatable about the shaft 23, and lifted up by the cartridge PY through the inner surface (ground surface) Q in the vicinity of the boss 71*a*. Therefore, an angle formed between the array 6 and the belt 9 prior to the detachment of the cartridge PY from the main body 100A of the apparatus is also θ1. In this embodiment, θ1 is set to be equal to 3°. At this time, the cartridge PY has already been spaced away from the belt 9 with respect to the exposure position at the time of image formation, and hence has already been in such a state as not to interfere with the belt 9 when being detached from the main body 100A of the apparatus.

Figure 15A:
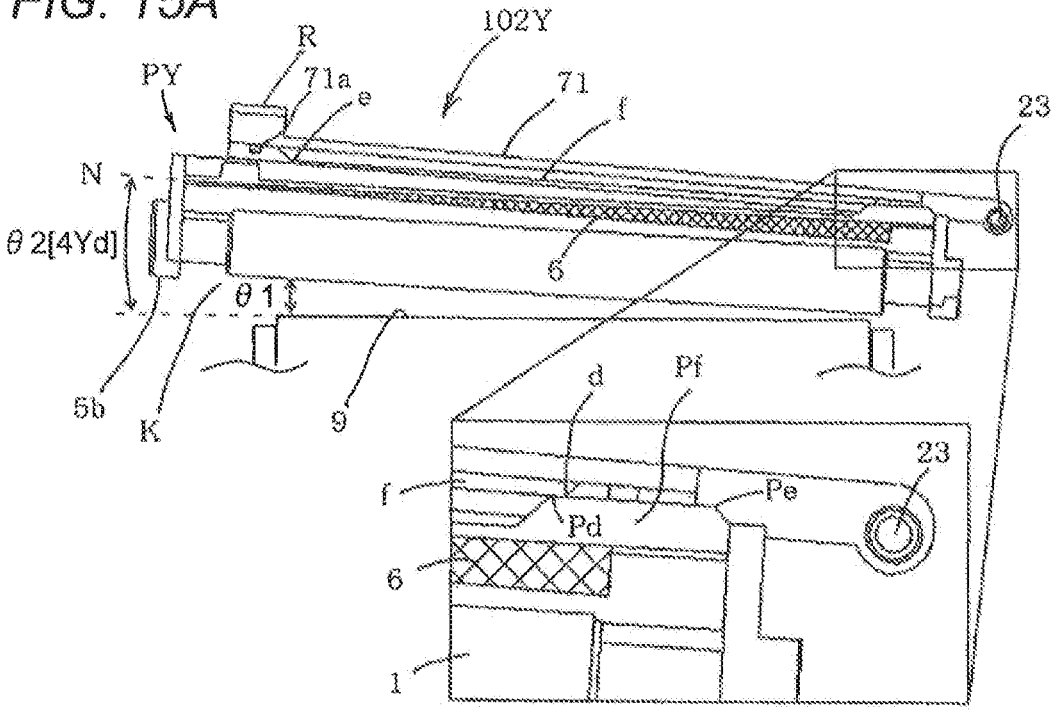
FIG. 15A is an explanatory diagram of a rotating operation of the holder holding the array, according to process-cartridge-pulling-out movement.

FIG. 15A illustrates a timing at which the cartridge PY starts to be detached from the main body 100A of the apparatus while the protruded-thread portion Pc of the cartridge PY is guided along the guide groove portion 26*c* of the guide 26. At this time, the point Pd of the protruding portion Pf of the cartridge PY moves below the point "d" of the slope portion "f" of the holder 71, and the holder 71 is lifted up about the shaft 23 in accordance therewith. As a result, the array 6 forms the angle θ2[4Yd] with respect to the belt 9, and in accordance therewith, is arranged (retracted position N) in such a manner that the position of the array 6 with respect to the drum 1 is farther than that (exposure position M) at the time of image formation. In this embodiment, θ2[4Yd] is set to be equal to 4.5°. At this time, the array 6 is at such a retracted position N as to be spaced away from the drum 1 with respect to the exposure position M at the time of image formation. Thus, the cartridge PY can be detached from the main body 100A of the apparatus without any problems.

Figure 15B:
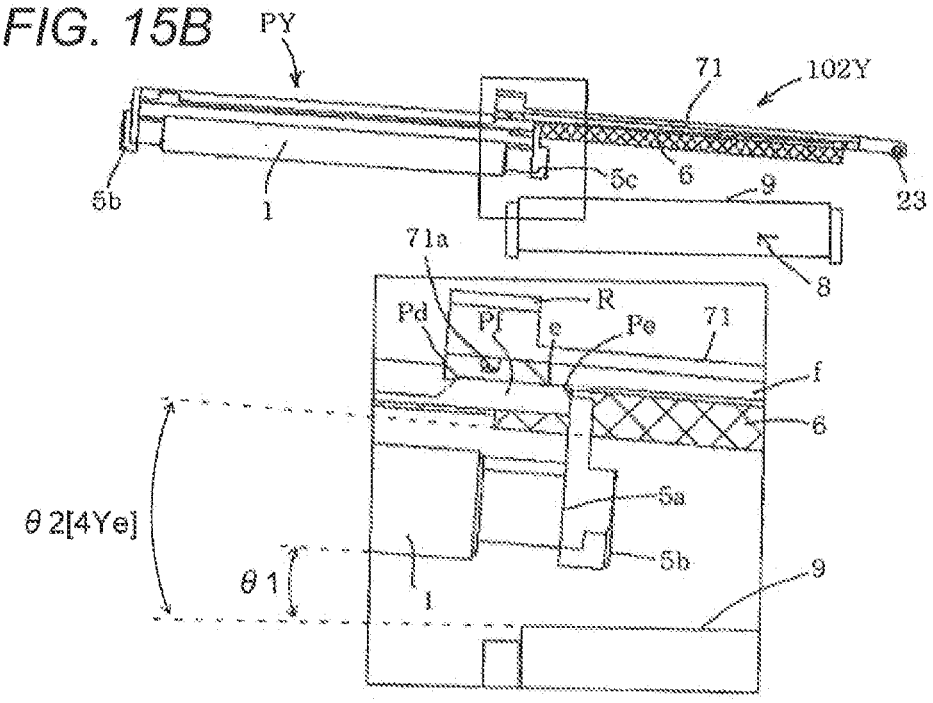
FIG. 15B is an explanatory diagram of a rotating operation of the holder holding the array, according to process-cartridge-pulling-out movement.

FIG. 15B illustrates a state immediately before a completion of the detachment of the cartridge PY from the main body 100A of the apparatus. At this time, the point Pe of the protruding portion Pf of the cartridge PY moves below the point e of the slope portion "f" of the holder 71, and the holder 71 is rotated about the shaft 23 in accordance therewith. As a result, the array 6 forms the angle θ2[4Ye] with respect to the belt 9, and in accordance therewith, is arranged in such a manner that the position of the array 6 with respect to the drum 1 is farther than that (exposure position M) at the time of image formation. In this embodiment, θ2[4Ye] is set to be equal to 3.8°. Also at this time, the array 6 maintains such a position as to be spaced away from the drum 1 with respect to the exposure position M at the time of image formation. Thus, the cartridge PY can be detached from the main body 100A of the apparatus without any problems.

Figure 16:
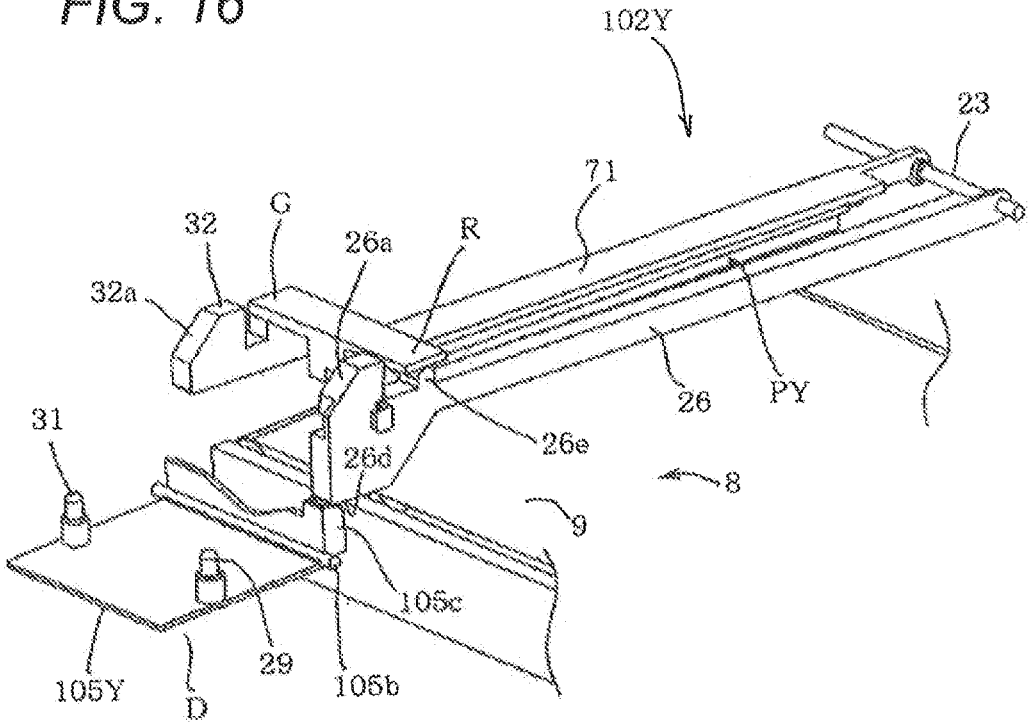
FIG. 16 illustrates a position of the holder after detachment of the process cartridge.

FIG. 16 illustrates a position of the holder 71 after detachment of the cartridge PY. Although being held in contact with the ground surface Q (FIG. 14A) on the cartridge PY at the time of image formation, the holder 71 is temporarily grounded to the projecting portion 26*e* of the guide 26 at the right-side jetty portion R of the holder 71 in a state in which the cartridge PY is not provided.

Further, the cartridge PY can be inserted only by the operations reverse to that in the above-mentioned detaching procedure. Along with the start of the insertion of the cartridge PY, the protruding portion Pf of the cartridge PY moves below the slope portion "f" of the holder 71. With this, the array 6 is spaced away from the drum 1, and hence the insertion can be completed without interference between the drum 1 and the array 6. Further, similarly to Embodiment 1, the interlocking structure of the door 105Y and the holder 71 enables completion of the insertion without interference of the drum 1 with respect to the belt 9 from the start to completion of the insertion.

Only the case of the first cartridge PY has been described above, but the other second to fourth cartridges PM, PC, and PK are replaced in the similar way.

As described hereinabove, in this embodiment, the cartridge P is mounted and detached substantially parallel to the rotation axial direction of the drum 1. Simultaneously, the drum 1 enters such a state as to be separated from the belt 9, and the array 6 enters such a state as to be spaced away with respect to the position (exposure position M) from the drum 1 at the time of image formation. Thus, the cartridge P can be mounted and detached without being brought into contact with the belt 9 or the array 6. In other words, the array 6 may be spaced away from the cartridge P in the apparatus main body. In addition, the array 6 is not exposed to dust in the outside air. As a result, a highly reliable image forming apparatus with no fouling of the array 6 is attained. Further, the array 6 cannot be touched by an operator, and hence the operator does not need to pay attention to the array 6 when replacing the cartridge P. As a result, an image forming apparatus having high operability is attained. Still further, the structure in which the array 6 is separated from the drum 1 in association with the mounting and detaching of the cartridge P enables provision of a space-saving interlocking mechanism constituted only by two components: the cartridge P and the array 6, which contributes to downsizing of a product.

The above-mentioned embodiment is summarized as follows. The electrophotographic image forming apparatus 100 forms an image on the recording medium S in the state in which the process cartridge P including the electrophotographic photosensitive drum 1 is detachably mounted to the main body 100A of the apparatus of the electrophotographic image forming apparatus 100. The electrophotographic image forming apparatus 100 includes the cartridge supporting member 26 for detachably mounting the cartridge P substantially parallel to the rotation axial direction of the drum 1. The supporting member 26 is arranged rotatably about the supporting point 23 on the downstream side in the process-cartridge-insertion direction with respect to the main body 100A of the apparatus. In this context, the supporting member 26 supports the cartridge P so that the cartridge P can be positioned to such an image forming position J as to perform image formation and such a retracted position K as to be retracted away from the image forming position J. Further, the electrophotographic image forming apparatus 100 includes the light emitting member 6 including the multiple light emitting elements which are provided side-by-side in the rotation axial direction of the drum 1 and emit light for exposing the drum 1 according to image information in the state in which the cartridge P is at the image forming position J. Still further, the electrophotographic image forming apparatus 100 includes the light-emitting-member supporting member 71 arranged rotatably about the supporting point 23 on the downstream side in the process-cartridge-insertion direction with respect to the main body 100A of the apparatus and supporting the light emitting member 6. The supporting member 71 supports the light emitting member 6 so that the light emitting member 6 can be positioned to such an exposure position M as to expose the drum 1 with the light emission of the light emitting elements and such a retracted position N as to be retracted away from the exposure position M. Further, the electrophotographic image forming apparatus 100 includes the transfer member 8 for transferring a toner image formed on the drum 1 onto the recording medium S in the state in which the cartridge P is at the image forming position J, the transfer member 8 being positioned in the main body 100A of the apparatus. Still further, the electrophotographic image forming apparatus 100 includes the operation member 105 operated by a user when the user pushes the cartridge P in and pulls the cartridge P out of the main body 100A of the apparatus, the operation member 105 being capable of being positioned to the first operating position C and the second operating position D. The operation member 105 includes the interlocking member 105*c* in association with the operation of the operation member 105. In association with the operation member 105 operated from the second operating position D to the first operating position C, the interlocking member 105*c* rotates the supporting member 26 about the supporting point 23 so that the cartridge P is positioned to the image forming position J. In association with the operation member 105 operated from the first operating position C to the second operating position D, the interlocking member 105*c* rotates the supporting member 26 about the supporting point 23 in a direction away from the transfer member 8 so that the cartridge P is positioned to the retracted position K. With this, the cartridge P is held to enter a state in which the cartridge P is inclined at the angle θ1 with respect to the transfer member 8. Further, the mutual interference members Pf and "f" are arranged respectively on the cartridge P and the supporting member 71. When the cartridge P is moved in a detaching direction in a state of being held to enter a state in which the cartridge P is inclined at the angle θ1, those members Pf and "f" operate the supporting member 71 as follows. That is, until the cartridge P is completely pulled out, the supporting member 71 is rotated about the supporting point 23 in a direction away from the transfer member 8 so that the light emitting member 6 is positioned in the retracted position N. With this, the light emitting member 6 is held to enter a state in which the light emitting member 6 is inclined at the angle θ2 with respect to the transfer member 8. In addition, in a state in which the supporting member 71 is rotated in a direction away from the transfer member 8, when the cartridge P is engaged with the supporting member 26 and moved in the insertion direction, the members Pf and "f" operate the supporting member 71 as follows. That is, until the cartridge P is completely mounted to the supporting member 26, the supporting member 71 is rotated about the supporting point 23 in a direction away from the transfer member 8 so that the light emitting member 6 is positioned to the retracted position N. With this, the light emitting member 6 is held to enter a state in which the light emitting member 6 is inclined at the angle θ2 with respect to the transfer member 8. Note that, the relation between the angles θ1 and θ2 is $\theta 1<\theta 2$.

In the above-mentioned structure, the light emitting member 6 can be separated from the transfer member 8 at the angle θ2 in association with the operation at the time of mounting and detaching of the cartridge P. Thus, a simplest structure can be provided in which the light emitting member 6 can be retracted away from the cartridge P only by the mounting and detaching operations of the cartridge P.

Further, according to this embodiment, when the cartridge P is mounted and detached from the apparatus main body, the cartridge P is retracted away from the transfer member 8, and the light emitting member 6 is retracted away from the cartridge P inside the apparatus main body. With this, the light emitting member 6 is not exposed to dust in the outside air. As a result, a highly reliable electrophotographic image forming apparatus with no fouling of the light emitting member 6 is attained. Further, the light emitting member 6 cannot be touched by a user, and hence the user does not need to pay attention to the light emitting member 6 when replacing the cartridge P. As a result, an electrophotographic image forming apparatus having high operability is attained.

Still further, the operation member 105 is an openable and closable member with respect to the opening portion 106 provided in the main body 100A of the apparatus so that the cartridge P is pushed in and pulled out of the main body 100A of the apparatus. The operation member 105 is movable between such a first operating position C as to close the opening portion and such a second operating position D as to open the opening portion. With this, such an efficient structure can be provided that the cartridge P is retracted away from the transfer member 8 through the cartridge supporting member 26 in association with the opening operation of the openable and closable member 105. In this apparatus structure, the operation member 105 may include a lever member arranged separately from the above-mentioned openable and closable member 105.

Note that, examples of the light emitting elements of the light emitting member (array) 6 include electroluminescent elements such as a liquid crystal element, a semiconductor light-emitting diode, and an organic electroluminescent element (organic EL element). The semiconductor light-emitting diode is a semiconductor element which emits light through application of voltage. The organic EL element is an electronic material made of an organic compound which emits light through application of voltage, and is self-luminous. In the organic EL element, for example, an organic molecular light-emitting layer is sandwiched by two electrodes, and voltage is applied thereto. With this, electrons and holes injected from the respective electrodes are recombined with each other so as to excite organic molecules. The organic molecules thus excited return to the ground state, and light is emitted at this time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-126813, filed Jun. 2, 2010, which is hereby incorporated by reference herein in its entirety.

What is claimed is:

1. An image forming apparatus that forms an image on a recording medium, the image forming apparatus comprising:

a cartridge including a photosensitive member and configured to be removed from a main body of the apparatus;

a light emitting member having a plurality of light emitting diodes arranged in a rotational axis direction of the photosensitive member and configured to make the plurality of light emitting diodes emit light to expose the photosensitive member to the light; and a transfer member configured to transfer a toner image formed on the photosensitive member, wherein the cartridge is movable between a first position for forming the image on the recording medium and a second position retracted more from the transfer member than the first position, wherein the light emitting member is movable between a third position for exposing the photosensitive member in order to form the image on the recording medium and a fourth position retracted more from the cartridge than the third position, and wherein, when the cartridge is in the second position and when the light emitting member is in the fourth position, the cartridge is moveable along the rotation axis direction of the photosensitive member so that the cartridge can be removed from inside of the main body of the apparatus.

2. An image forming apparatus according to claim 1, wherein the cartridge is moved from the first position to the second position in a same direction as movement of the light emitting member from the third position to the fourth position, and a movement amount by which the light emitting member is moved from the third position to the fourth position is larger than a movement amount by which the cartridge is moved from the first position to the second position.

3. An image forming apparatus according to claim 1, further comprising:

a moving member movable with respect to the main body of the apparatus, wherein, when the moving member is in a predetermined position, the cartridge is in the first position and the light emitting member is in the third position, and when the moving member is moved from the predetermined position to another predetermined position, the cartridge is moved to the second position and the light emitting member is moved to the fourth position.

4. An image forming apparatus according to claim 3, wherein the main body of the apparatus is provided with an opening through which the cartridge passes when the cartridge is removed from the inside of the main body of the apparatus, and wherein the moving member is an openable and closable member configured to cover the opening when the openable and closable member is in the predetermined position and to open the opening for removing the cartridge from the inside of the main body of the apparatus when the openable and closable member is in the other predetermined position.

5. An image forming apparatus according to claim 1, wherein the light emitting member is moved from the third position to the fourth position within the inside of the main body of the apparatus.

6. An image forming apparatus according to claim 1, wherein the cartridge is moved from the first position to the second position within the inside of the main body of the apparatus.

7. An image forming apparatus according to claim 1, wherein the cartridge includes a charging member configured to charge the photosensitive member.

8. An image forming apparatus according to claim 1, wherein the cartridge includes a developing member configured to develop a latent image on the photosensitive member with developer.

9. An image forming apparatus according to claim 1, wherein the cartridge includes a member configured to remove developer from the photosensitive member.

10. An image forming apparatus that forms an image on a recording medium, the image forming apparatus comprising:

a plurality of cartridges each including a photosensitive member and configured to be removed from a main body of the apparatus;

a plurality of light emitting members each (i) corresponding to the photosensitive member of each of the plurality of cartridges, (ii) have a plurality of light emitting diodes arranged in a rotational axis direction of a corresponding photosensitive member, and (iii) is configured to make the plurality of light emitting diodes emit light to expose the corresponding photosensitive member to the light; and a transfer member configured to transfer a toner image formed on the photosensitive member of each of the plurality of cartridges, wherein each of the plurality of cartridges is movable between a first position for forming the image on the recording medium and a second position retracted more from the transfer member than the first position, wherein each of the plurality of light emitting members is movable between a third position for exposing the corresponding photosensitive member in order to form the image on the recording medium and a fourth position retracted more from a cartridge of the corresponding photosensitive member than the third position, and wherein, when one cartridge of the plurality of cartridges is in the second position and when a light emitting member corresponding to the one cartridge is in the fourth position, the one cartridge is moveable along the rotational axis direction of the corresponding photosensitive member so that the one cartridge can be removed from an inside of the main body of the apparatus.

11. An image forming apparatus according to claim 10, wherein the transfer member is a belt to which the toner image is transferred from the photosensitive member of each of the plurality of cartridges.

12. An image forming apparatus according to claim 11, wherein, when the plurality of cartridges are in the first position, the transfer member is disposed below the photosensitive member of each of the plurality of cartridges.

13. An image forming apparatus that forms an image on a recording medium, the image forming apparatus comprising:

a cartridge including a photosensitive member and configured to be removed from a main body of the apparatus;

a light emitting member having a plurality of light emitting diodes arranged in a rotational axis direction of the photosensitive member and configured to make the plurality of light emitting diodes emit light to expose the photosensitive member to the light; and a transfer member configured to transfer a toner image formed on the photosensitive member, wherein the cartridge is movable between a first position for forming the image on the recording medium and a second position retracted more from the transfer member than the first position, wherein the light emitting member is movable between a third position for exposing the photosensitive member in order to form the image on the recording medium and a fourth position retracted more from the cartridge than the third position, wherein the cartridge is moved in a same direction as a movement of the light emitting member from the third position to the fourth position so as to be moved from the first position to the second position, and a movement amount by which the light emitting member is moved from the third position to the fourth position is larger than a movement amount by which the cartridge is moved from the first position to the second position, and wherein, when the cartridge is in the second position and when the light emitting member is in the fourth position, the cartridge can be removed from an inside of the main body of the apparatus.

14. An image forming apparatus according to claim 13, further comprising:

a moving member movable with respect to the main body of the apparatus, wherein, when the moving member is in a predetermined position, the cartridge is in the first position and the light emitting member is in the third position, and when the moving member is moved from the predetermined position to another predetermined position, the cartridge is moved to the second position and the light emitting member is moved to the fourth position.

15. An image forming apparatus according to claim 14, wherein the main body of the apparatus is provided with an opening through which the cartridge passes when the cartridge is removed from the inside of the main body of the apparatus, and wherein the moving member is an openable and closable member configured to cover the opening when the openable and closable member is in the predetermined position and to open the opening for removing the cartridge from the inside of the main body of the apparatus when the openable and closable member is in the other predetermined position.

16. An image forming apparatus according to claim 13, wherein the light emitting member is moved from the third position to the fourth position within the inside of the main body of the apparatus.

17. An image forming apparatus according to claim 13, wherein the cartridge is moved from the first position to the second position within the inside of the main body of the apparatus.

18. An image forming apparatus according to claim 13, wherein the cartridge includes a charging member configured to charge the photosensitive member.

19. An image forming apparatus according to claim 13, wherein the cartridge includes a developing member configured to develop a latent image on the photosensitive member with developer.

20. An image forming apparatus according to claim 13, wherein the cartridge includes a member configured to remove developer from the photosensitive member.

21. An image forming apparatus that forms an image on a recording medium, the image forming apparatus comprising:

a plurality of cartridges each including a photosensitive member and configured to be removed from a main body of the apparatus;

a plurality of light emitting members each (i) corresponding to the photosensitive member of each of the plurality of cartridges, (ii) have a plurality of light emitting diodes arranged in a rotational axis direction of a corresponding photosensitive member, and (iii) is configured to make the plurality of light emitting diodes emit light to expose the corresponding photosensitive member to the light; and a transfer member configured to transfer a toner image formed on the photosensitive member of each of the plurality of cartridges, wherein each of the plurality of cartridges is movable between a first position for forming the image on the recording medium and a second position retracted more from the transfer member than the first position, wherein each of the plurality of light emitting members is movable between a third position for exposing the corresponding photosensitive member in order to form the image on the recording medium and a fourth position retracted more from a cartridge of the corresponding photosensitive member than the third position, wherein each of the plurality of cartridges is moved in a same direction as a movement of a corresponding light emitting member from the third position to the fourth position so as to be moved from the first position to the second position, and a movement amount by which the corresponding light emitting member is moved from the third position to the fourth position is larger than a movement amount by which each of the plurality of cartridges is moved from the first position to the second position, and wherein, when one cartridge of the plurality of cartridges is in the second position and when a light emitting member corresponding to the one cartridge is in the fourth position, the one cartridge can be removed from an inside of the main body of the apparatus.

22. An image forming apparatus according to claim 21, wherein the transfer member is a belt to which the toner image is transferred from the photosensitive member of each of the plurality of cartridges.

23. An image forming apparatus according to claim 22, wherein, when the plurality of cartridges are in the first position, the transfer member is disposed below the photosensitive member of each of the plurality of cartridges.

24. An image forming apparatus which that an image on a recording medium, the image forming apparatus comprising:

a cartridge including a photosensitive member and configured to be removed from a main body of the apparatus;

a light emitting member having a plurality of light emitting diodes arranged in a rotational axis direction of the photosensitive member and configured to make the plurality of light emitting diodes emit light to expose the photosensitive member to the light;

a transfer member configured to transfer a toner image formed on the photosensitive member; and a single moving member movable with respect to the main body of the apparatus, wherein, when the single moving member is in a predetermined position, exposure by the light emitting member and transfer by the transfer member are performed for forming the image on the recording medium, wherein, when the single moving member is moved from the predetermined position to another predetermined position, (i) the light emitting member and the photosensitive member are more separated from each other than when the single moving member is in the predetermined position and (ii) the photosensitive member and the transfer member are more separated from each other than when the single moving member is in the predetermined position, and wherein, when the single moving member is in the other predetermined position, the cartridge is moveable along the rotational axis direction of the photosensitive member so that the cartridge can be removed from an inside of the main body of the apparatus.

25. An image forming apparatus according to claim 24, wherein the main body of the apparatus is provided with an opening through which the cartridge passes when the cartridge is removed from the inside of the main body of the apparatus, and wherein the single moving member is an openable and closable member configured to cover the opening when the openable and closable member is in the predetermined position and to open the opening for removing the cartridge from the inside of the main body of the apparatus when the openable and closable member is in the other predetermined position.

26. An image forming apparatus according to claim 24, wherein, when the single moving member is in the predetermined position, the photosensitive member and the transfer member abut against each other and the light emitting member and the photosensitive member abut against each other, and when the single moving member is in the other predetermined position, the photosensitive member and the transfer member are separated from each other and the light emitting member and the photosensitive member are separated from each other.

27. An image forming apparatus according to claim 24, wherein, when the single moving member is in the predetermined position and when the single moving member is in the other predetermined position, the light emitting member is within the inside of the main body of the apparatus.

28. An image forming apparatus according to claim 24, wherein the cartridge includes a charging member configured to charge the photosensitive member.

29. An image forming apparatus according to claim 24, wherein the cartridge includes a developing member configured to develop a latent image on the photosensitive member with developer.

30. An image forming apparatus according to claim 24, wherein the cartridge includes a member configured to remove developer from the photosensitive member.

31. An image forming apparatus that forms an image on a recording medium, the image forming apparatus comprising:

a cartridge including a photosensitive member and configured to be removed from a main body of the apparatus;

a light emitting member having a plurality of light emitting elements arranged in a rotational axis direction of the photosensitive member and configured to make the plurality of light emitting elements emit light to expose the photosensitive member to the light; and a transfer member configured to transfer a toner image formed on the photosensitive member;

wherein the cartridge is movable between a first position for forming the image on the recording medium and a second position retracted more from the transfer member than the first position, wherein the light emitting member is movable between a third position for exposing the photosensitive member in order to form the image on the recording medium and a fourth position retracted more from the cartridge than the third position, and wherein, when the cartridge is in the second position and when the light emitting member is in the fourth position, the cartridge is moveable along the rotational axis direction of the photosensitive member so that the cartridge can be removed from an inside of the main body of the apparatus.

32. An image forming apparatus according to claim 31, wherein the cartridge is moved in a same direction as a movement of the light emitting member from the third position to the fourth position so as to be moved from the first position to the second position, and a movement amount by which the light emitting member is moved from the third position to the fourth position is larger than a movement amount by which the cartridge is moved from the first position to the second position.

33. An image forming apparatus according to claim 31, further comprising:

a moving member movable with respect to the main body of the apparatus, wherein, when the moving member is in a predetermined position, the cartridge is in the first position and the light emitting member is in the third position, and when the moving member is moved from the predetermined position to another predetermined position, the cartridge is moved to the second position and the light emitting member is moved to the fourth position.

34. An image forming apparatus according to claim 33, wherein the main body of the apparatus is provided with an opening through which the cartridge passes when the cartridge is removed from the inside of the main body of the apparatus, and wherein the moving member is an openable and closable member configured to cover the opening when the openable and closable member is in the predetermined position and to open the opening for removing the cartridge from the inside of the main body of the apparatus when the openable and closable member is in the other predetermined position.

35. An image forming apparatus according to claim 31, wherein the light emitting member is moved from the third position to the fourth position within the inside of the main body of the apparatus.

36. An image forming apparatus according to claim 31, wherein the cartridge is moved from the first position to the second position within the inside of the main body of the apparatus.

37. An image forming apparatus according to claim 31, wherein the cartridge includes a charging member configured to charge the photosensitive member.

38. An image forming apparatus according to claim 31, wherein the cartridge includes a developing member configured to develop a latent image on the photosensitive member with developer.

39. An image forming apparatus according to claim 31, wherein the cartridge includes a member configured to remove developer from the photosensitive member.

40. An image forming apparatus which forms an image on a recording medium, the image forming apparatus comprising:

a plurality of cartridges each including a photosensitive member and configured to be removed from a main body of the apparatus;

a plurality of light emitting members each corresponding to the photosensitive member of each of the plurality of cartridges and each having a plurality of light emitting elements arranged in a rotational axis direction of a corresponding photosensitive member and each configured to make the plurality of light emitting elements emit light to expose the corresponding photosensitive member to the light; and a transfer member configured to transfer a toner image formed on the photosensitive member of each of the plurality of cartridges, wherein each of the plurality of cartridges is movable between a first position for forming the image on the recording medium and a second position retracted more from the transfer member than the first position, wherein each of the plurality of light emitting members is movable between a third position for exposing the corresponding photosensitive member in order to form the image on the recording medium and a fourth position retracted more from a cartridge of the corresponding photosensitive member than the third position, and wherein, when one cartridge of the plurality of cartridges is in the second position and when a light emitting member corresponding to the one cartridge is in the fourth position, the one cartridge is moved along the rotational axis direction of the corresponding photosensitive member so that the one cartridge can be removed from an inside of the main body of the apparatus.

41. An image forming apparatus according to claim 40, wherein the transfer member is a belt to which the toner image is transferred from the photosensitive member of each of the plurality of cartridges.

42. An image forming apparatus according to claim 41, wherein, when the plurality of cartridges are in the first position, the transfer member is disposed below the photosensitive member of each of the plurality of cartridges.

43. An image forming apparatus that forms an image on a recording medium, the image forming apparatus comprising:

a cartridge including a photosensitive member and configured to be removed from a main body of the apparatus;

a light emitting member having a plurality of light emitting elements arranged in a rotational axis direction of the photosensitive member and configured to make the plurality of light emitting elements emit light to expose the photosensitive member to the light; and a transfer member configured to transfer a toner image formed on the photosensitive member, wherein the cartridge is movable between a first position for forming the image on the recording medium and a second position retracted more from the transfer member than the first position, wherein the light emitting member is movable between a third position for exposing the photosensitive member in order to form the image on the recording medium and a fourth position retracted more from the cartridge than the third position, wherein the cartridge is moved in a same direction as a movement of the light emitting member from the third position to the fourth position so as to be moved from the first position to the second position, and a movement amount by which the light emitting member is moved from the third position to the fourth position is larger than a movement amount by which the cartridge is moved from the first position to the second position, and wherein, when the cartridge is in the second position and when the light emitting member is in the fourth position, the cartridge can be removed from an inside of the main body of the apparatus.

44. An image forming apparatus according to claim 43, further comprising:

a moving member movable with respect to the main body of the apparatus, wherein, when the moving member is in a predetermined position, the cartridge is in the first position and the light emitting member is in the third position, and when the moving member is moved from the predetermined position to another predetermined position, the cartridge is moved to the second position and the light emitting member is moved to the fourth position.

45. An image forming apparatus according to claim 44, wherein the main body of the apparatus is provided with an opening through which the cartridge passes when the cartridge is removed from the inside of the main body of the apparatus, and wherein the moving member is an openable and closable member configured to cover the opening when the openable and closable member is in the predetermined position and to open the opening for removing the cartridge from the inside of the main body of the apparatus when the openable and closable member is in the other predetermined position.

46. An image forming apparatus according to claim 43, wherein the light emitting member is moved from the third position to the fourth position within the inside of the main body of the apparatus.

47. An image forming apparatus according to claim 43, wherein the cartridge is moved from the first position to the second position within the inside of the main body of the apparatus.

48. An image forming apparatus according to claim 43, wherein the cartridge includes a charging member configured to charge the photosensitive member.

49. An image forming apparatus according to claim 43, wherein the cartridge includes a developing member configured to develop a latent image on the photosensitive member with developer.

50. An image forming apparatus according to claim 43, wherein the cartridge includes a member configured to remove developer from the photosensitive member.

51. An image forming apparatus which forms an image on a recording medium, the image forming apparatus comprising:

a plurality of cartridges each including a photosensitive member and configured to be removed from a main body of the apparatus;

a plurality of light emitting members each (i) corresponding to the photosensitive member of each of the plurality of cartridges, (ii) have a plurality of light emitting elements arranged in a rotational axis direction of a corresponding photosensitive member, and (iii) is configured to make the plurality of light emitting elements emit light to expose the corresponding photosensitive member to the light; and a transfer member configured to transfer a toner image formed on the photosensitive member of each of the plurality of cartridges, wherein each of the plurality of cartridges is movable between a first position for forming the image on the recording medium and a second position retracted more from the transfer member than the first position, wherein each of the plurality of light emitting members is movable between a third position for exposing the corresponding photosensitive member in order to form the image on the recording medium and a fourth position retracted more from a cartridge of the corresponding photosensitive member than the third position, wherein each of the plurality of cartridges is moved in a same direction as a movement of a corresponding light emitting member from the third position to the fourth position so as to be moved from the first position to the second position, and a movement amount by which the corresponding light emitting member is moved from the third position to the fourth position is larger than a movement amount by which each of the plurality of cartridges is moved from the first position to the second position, and wherein, when one cartridge of the plurality of cartridges is in the second position and when a light emitting member corresponding to the one cartridge is in the fourth position, the one cartridge can be removed from an inside of the main body of the apparatus.

52. An image forming apparatus according to claim 51, wherein the transfer member is a belt to which the toner image is transferred from the photosensitive member of each of the plurality of cartridges.

53. An image forming apparatus according to claim 52, wherein, when the plurality of cartridges are in the first position, the transfer member is disposed below the photosensitive member of each of the plurality of cartridges.

54. An image forming apparatus that forms an image on a recording medium, the image forming apparatus comprising:

a cartridge including a photosensitive member and configured to be removed from a main body of the apparatus;

a light emitting member having a plurality of light emitting elements arranged in a rotational axis direction of the photosensitive member and configured to make the plurality of light emitting elements emit light to expose the photosensitive member to the light;

a transfer member configured to transfer a toner image formed on the photosensitive member; and a single moving member movable with respect to the main body of the apparatus, wherein, when the single moving member is in a predetermined position, exposure by the light emitting member and transfer by the transfer member are performed for forming the image on the recording medium, wherein, when the single moving member is moved from the predetermined position to another predetermined position, the light emitting member and the photosensitive member are more separated from each other and the photosensitive member and the transfer member are more separated from each other than when the single moving member is in the predetermined position, and wherein, when the single moving member is in the other predetermined position, the cartridge is moveable along the rotational axis direction of the photosensitive member so that the cartridge can be removed from an inside of the main body of the apparatus.

55. An image forming apparatus according to claim 54, wherein the main body of the apparatus is provided with an opening through which the cartridge passes when the cartridge is removed from the inside of the main body of the apparatus, and wherein the single moving member is an openable and closable member configured to cover the opening when the openable and closable member is in the predetermined position and to open the opening for removing the cartridge from the inside of the main body of the apparatus when the openable and closable member is in the other predetermined position.

56. An image forming apparatus according to claim 54, wherein, when the single moving member is in the predetermined position, the photosensitive member and the transfer member abut against each other and the light emitting member and the photosensitive member abut against each other, and when the single moving member is in the other predetermined position, the photosensitive member and the transfer member are separated from each other and the light emitting member and the photosensitive member are separated from each other.

57. An image forming apparatus according to claim 54, wherein, when the single moving member is in the predetermined position and when the single moving member is in the other predetermined position, the light emitting member is within the inside of the main body of the apparatus.

58. An image forming apparatus according to claim 54, wherein the cartridge includes a charging member configured to charge the photosensitive member.

59. An image forming apparatus according to claim 54, wherein the cartridge includes a developing member configured to develop a latent image on the photosensitive member with developer.

60. An image forming apparatus according to claim 54, wherein the cartridge includes a member configured to remove developer from the photosensitive member.

* * * * *